US012292056B2

(12) United States Patent
Heeter et al.

(10) Patent No.: US 12,292,056 B2
(45) Date of Patent: May 6, 2025

(54) SEGMENTED VARIABLE FAN OUTLET GUIDE VANE WITH GEAR ASSEMBLY

(71) Applicant: Rolls-Royce North American Technologies Inc., Indianapolis, IN (US)

(72) Inventors: Robert W. Heeter, Indianapolis, IN (US); Daniel E. Molnar, Jr., Indianapolis, IN (US); Gregory J. Hebert, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 18/600,610

(22) Filed: Mar. 8, 2024

(65) Prior Publication Data

US 2024/0309886 A1 Sep. 19, 2024

Related U.S. Application Data

(60) Provisional application No. 63/452,895, filed on Mar. 17, 2023.

(51) Int. Cl.

| | |
|---|---|
| ***F04D 29/54*** | (2006.01) |
| ***F01D 17/16*** | (2006.01) |
| ***F04D 19/00*** | (2006.01) |

(52) U.S. Cl.

CPC ..... *F04D 29/542* (2013.01); *F01D 17/162* (2013.01); *F04D 19/002* (2013.01)

(58) Field of Classification Search

None

See application file for complete search history.

(56) References Cited

U.S. PATENT DOCUMENTS

| | | | |
|---|---|---|---|
| 3,237,918 | A | 3/1966 | Le et al. |
| 3,397,836 | A | 8/1968 | Badger et al. |
| 3,632,224 | A | 1/1972 | Wright et al. |
| 3,887,297 | A | 6/1975 | Welchek |
| 4,053,256 | A | 10/1977 | Hertel |
| 4,705,452 | A | 11/1987 | Karadimas |
| 4,791,783 | A | 12/1988 | Neitzel |

(Continued)

FOREIGN PATENT DOCUMENTS

| | | |
|---|---|---|
| EP | 2659112 | 10/2020 |
| GB | 893054 | 4/1962 |

OTHER PUBLICATIONS

Zhang et al.—CN 109578335 A + machine translation (Year: 2019).*

*Primary Examiner* — Juan G Flores

(74) *Attorney, Agent, or Firm* — Barnes & Thornburg

(57) ABSTRACT

A fan assembly for a gas turbine engine includes a fan duct, a fan, and an outlet guide vane assembly located in the fan duct axially downstream of the fan. The outlet guide vane assembly includes a first variable leading edge outlet guide vane that extends radially relative to the central axis and includes a leading edge portion and a fixed aft portion, the leading edge portion including a tip segment configured to rotate about a leading edge pitch axis and a hub segment located radially inward of and separate from the tip segment, the hub segment configured to independently rotate about the leading edge pitch axis relative to the tip segment. The assembly further includes two unique gear assemblies each configured to rotate one of the tip and hub segments.

20 Claims, 21 Drawing Sheets

(56) References Cited

U.S. PATENT DOCUMENTS 4,832,568 A 5/1989 Roth et al.
4,995,786 A 2/1991 Wheeler et al.
5,074,752 A 12/1991 Murphy et al.
5,259,187 A 11/1993 Dunbar et al.
5,314,301 A * 5/1994 Knight ..... F01D 17/162 415/161
5,494,404 A 2/1996 Furseth et al.
6,179,559 B1 1/2001 Weaver
6,283,705 B1 9/2001 Rice et al.
6,371,725 B1 4/2002 Manteiga et al.
6,619,916 B1 9/2003 Capozzi et al.
7,114,911 B2 * 10/2006 Martin ..... F04D 29/563 415/1
7,118,331 B2 10/2006 Shahpar
7,444,802 B2 4/2008 Parry
7,722,321 B2 5/2010 Lhoest et al.
7,730,714 B2 6/2010 Wood et al.
7,942,632 B2 5/2011 Lord et al.
7,959,408 B2 6/2011 Belmonte
8,066,474 B1 11/2011 Jansen et al.
8,333,546 B2 12/2012 Colotte et al.
8,347,633 B2 * 1/2013 Smith ..... F01D 17/162 60/771
8,469,662 B2 6/2013 Lebrun et al.
8,641,367 B2 2/2014 Norris et al.
8,727,697 B2 5/2014 Eifert
8,915,703 B2 12/2014 Mohammed
9,091,174 B2 7/2015 Bagnall
9,103,228 B2 8/2015 Waugh et al.
9,157,366 B2 10/2015 Bernard
9,303,520 B2 4/2016 Hasting et al.
9,303,531 B2 4/2016 Hasting et al.
9,506,361 B2 11/2016 Fielding et al.
9,617,868 B2 4/2017 Bloxham et al.
9,885,291 B2 2/2018 Lecordix et al.
9,957,823 B2 * 5/2018 Epstein ..... F02C 9/20
10,060,286 B2 * 8/2018 Izquierdo ..... F02C 9/20
10,100,663 B2 10/2018 Longworth et al.
10,247,018 B2 4/2019 Topol et al.
10,259,565 B2 4/2019 Ramakrishnan et al.
10,288,079 B2 5/2019 Skertic
10,458,261 B2 10/2019 Got et al.
10,495,108 B2 12/2019 Conner et al.
10,508,660 B2 12/2019 Hall et al.
10,527,060 B2 1/2020 Reynolds et al.
10,563,593 B2 2/2020 McNeil et al.
10,711,626 B2 7/2020 Humhauser et al.
10,737,801 B2 8/2020 Sands et al.
10,738,627 B2 8/2020 Gallagher et al.
10,794,281 B2 10/2020 Nestico et al.
10,815,802 B2 10/2020 Prasad
10,907,489 B2 2/2021 Papin et al.
11,131,323 B2 9/2021 Suciu et al.
11,384,656 B1 7/2022 Knechtel et al.
11,542,864 B2 1/2023 Bryan
12,116,120 B2 * 10/2024 Choi ..... B64C 29/005
2005/0147492 A1 7/2005 Mahoney et al.
2006/0045728 A1 * 3/2006 Martin ..... F04D 29/563 415/1
2007/0119150 A1 5/2007 Wood et al.
2009/0297334 A1 12/2009 Norris et al.
2010/0014977 A1 1/2010 Shattuck
2011/0167792 A1 7/2011 Johnson et al.
2012/0163960 A1 6/2012 Ress et al.
2013/0276425 A1 10/2013 Rittenhouse
2013/0319009 A1 12/2013 Parente
2015/0361819 A1 * 12/2015 Epstein ..... F01D 1/023 415/208.1
2016/0069204 A1 * 3/2016 Izquierdo ..... F01D 17/162 415/68
2016/0333729 A1 11/2016 Miller et al.
2017/0058831 A1 3/2017 Bryan et al.
2017/0218842 A1 8/2017 Nestico et al.
2020/0088108 A1 3/2020 Klein et al.
2023/0114141 A1 * 4/2023 Choi ..... B64C 29/0025 244/12.4

* cited by examiner

SEGMENTED VARIABLE FAN OUTLET GUIDE VANE WITH GEAR ASSEMBLY

CROSS-REFERENCE TO RELATED APPLICATIONS

This application claims the benefit under 35 U.S.C. § 119(e) of U.S. Provisional Application Ser. No. 63/452,895, filed on Mar. 17, 2023, the entire disclosure of which is incorporated herein by reference.

STATEMENT REGARDING FEDERALLY SPONSORED RESEARCH OR DEVELOPMENT

Embodiments of the present disclosure were made with government support under Contract No. FA8650-19-F-2078 awarded by the U.S. Air Force. The government may have certain rights.

FIELD OF THE DISCLOSURE

The present disclosure relates generally to gas turbine engines, and more specifically to fan assemblies of gas turbine engines.

BACKGROUND

Gas turbine engines are used to power aircraft, watercraft, power generators, and the like. Gas turbine engines typically include an engine core having a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Leftover products of the combustion are exhausted out of the turbine and may provide thrust in some applications.

Gas turbine engines also typically include a fan positioned within an inlet duct of the gas turbine engine. The fan includes rotating blades that that force air into the compressor section of the engine, as well as potentially providing additional thrust via forcing air around the engine core through bypass ducts. The fan blades may experience various operability issues due to factors such as variations in the intake airflow and pressure fluctuations within the inlet and the bypass ducts.

SUMMARY

The present disclosure may comprise one or more of the following features and combinations thereof.

A fan assembly for a gas turbine engine according to the present disclosure includes a fan duct arranged circumferentially around a central axis, a fan comprising a plurality of fan blades that extend radially outward relative to the central axis and that are adapted to rotate about the central axis to force fan exit air toward an aft end of the fan duct, and an outlet guide vane assembly located in the fan duct axially downstream of the fan and configured to adjust a direction of incoming fan exit air received from the plurality of fan blades and reduce incidence between the outlet guide vane assembly and the fan exit air.

The outlet guide vane assembly includes a first variable leading edge outlet guide vane that extends radially relative to the central axis and includes a leading edge portion and a fixed aft portion, the leading edge portion including a first tip segment configured to rotate about a leading edge pitch axis and a first hub segment located radially inward of and separate from the first tip segment, the first hub segment configured to independently rotate about the leading edge pitch axis relative to the first tip segment, the first tip segment including a first plurality of gear teeth arranged thereon, the first hub segment including a second plurality of gear teeth arranged thereon, and a first actuation assembly including a first actuation rod, a first gear assembly coupled to the first actuation rod and in engagement with the first plurality of gear teeth of the first tip segment, and a second gear assembly coupled to the first actuation rod and in engagement with the second plurality of gear teeth of the first hub segment, wherein the first actuation rod is configured to be selectively rotated so as to rotate the first and second gear assemblies, wherein rotation of the first gear assembly causes rotation of the first tip segment about the leading edge pitch axis to a first pitch angle relative to the incoming fan exit air, and wherein rotation of the second gear assembly causes rotation of the first hub segment about the leading edge pitch axis to a second pitch angle relative to the incoming fan exit air.

In some embodiments, the first actuation assembly is configured to rotate the first tip segment and the first hub segment to the first pitch angle and the second pitch angle which is different than the first pitch angle.

In some embodiments, the first gear assembly includes a first gear rotatably coupled to a first cavity formed in the fixed aft portion and in engagement with the first plurality of gear teeth of the first tip segment, the first gear assembly further includes a second gear fixedly coupled to the first actuation rod and in engagement with the first gear, and rotation of the second gear in a first rotational direction via the first actuation rod causes rotation of the first tip segment in the first rotational direction via engagement with the first gear.

In some embodiments, the second gear assembly is radially spaced apart from the first gear assembly and includes a third gear rotatably coupled to a second cavity formed in the fixed aft portion and in engagement with the second plurality of gear teeth of the first hub segment, the second gear assembly further includes a fourth gear fixedly coupled to the first actuation rod and in engagement with the third gear, and rotation of the fourth gear in the first rotational direction via the first actuation rod causes rotation of the first hub segment in the first rotational direction via engagement with the third gear.

In some embodiments, rotation of the second and fourth gears via the first actuation rod in a second rotational direction opposite the first rotational direction causes the first tip and hub segments to rotate in the second rotational direction.

In some embodiments, the second and fourth gears are smaller than and include fewer teeth than the first and third gears.

In some embodiments, the first actuation assembly is arranged radially generally outward of the fixed aft portion and includes a first actuation head, and the first actuation rod is fixedly coupled to the first actuation head such that rotation of the first actuation head causes rotation of the first actuation rod.

In some embodiments, first actuation assembly further includes a first actuation arm coupled to the first actuation head and extending generally axially aft therefrom, pivoting of the first actuation arm about a rotation axis of the first actuation head causes rotation of the first actuation head which causes rotation of the first actuation rod.

In some embodiments, the fixed aft portion includes an actuation rod receiving cavity formed therethrough, and the first actuation head is circumferentially aligned with the fixed aft portion such that the first actuation rod extends through the actuation rod receiving cavity.

In some embodiments, the first actuation head is circumferentially offset from the fixed aft portion such that the first actuation rod radially extends circumferentially adjacent to the fixed aft portion.

In some embodiments, the outlet guide vane assembly further includes a first annular ring extending circumferentially about the central axis, an axially aft end of the first actuation arm is connected to the first annular ring, and circumferential movement of the first annular ring causes movement of the first actuation arm generally circumferentially relative to the first actuation head which causes the first actuation arm to pivot about the rotation axis of the first actuation head which causes rotation of the first actuation head which causes rotation of the first actuation rod.

In some embodiments, the first variable leading edge outlet guide vane further includes a central segment arranged between the first tip segment and the first hub segment such that the first tip segment and the first hub segment are radially spaced apart.

In some embodiments, the central segment is coupled to and extends axially away from an axially forward side of the fixed aft portion.

According to a further aspect of the present disclosure, a fan assembly for a gas turbine engine includes a fan duct arranged circumferentially around a central axis, a fan adapted to rotate about the central axis to force fan exit air toward an aft end of the fan duct, and an outlet guide vane assembly located in the fan duct axially downstream of the fan and configured to adjust a direction of incoming fan exit air received from the plurality of fan blades and reduce incidence between the outlet guide vane assembly and the fan exit air.

The outlet guide vane assembly includes a first variable leading edge outlet guide vane including a leading edge portion and a fixed aft portion, the leading edge portion including a first tip segment configured to rotate about a leading edge pitch axis, the first tip segment including a first plurality of gear teeth arranged thereon, and a first actuation assembly including a first actuation rod and a first gear assembly coupled to the first actuation rod and in engagement with the first plurality of gear teeth of the first tip segment, wherein the first actuation rod is configured to be selectively rotated so as to rotate the first gear assembly, and wherein rotation of the first gear assembly causes rotation of the first tip segment about the leading edge pitch axis to a first pitch angle relative to the incoming fan exit air.

In some embodiments, the leading edge portion further includes a first hub segment located radially inward of and separate from the first tip segment, the first hub segment configured to independently rotate about the leading edge pitch axis relative to the first tip segment, and wherein the first hub segment includes a second plurality of gear teeth arranged thereon.

In some embodiments, the first actuation assembly further includes a second gear assembly coupled to the first actuation rod and in engagement with the second plurality of gear teeth of the first hub segment, the selective rotation of the first actuation rod rotates the second gear assembly, and rotation of the second gear assembly causes rotation of the first hub segment about the leading edge pitch axis to a second pitch angle relative to the incoming fan exit air.

In some embodiments, the first gear assembly includes a first gear rotatably coupled to a first cavity formed in the fixed aft portion and in engagement with the first plurality of gear teeth of the first tip segment, the first gear assembly further includes a second gear fixedly coupled to the first actuation rod and in engagement with the first gear, and rotation of the second gear in a first rotational direction via the first actuation rod causes rotation of the first tip segment in the first rotational direction via engagement with the first gear.

In some embodiments, the second gear assembly is radially spaced apart from the first gear assembly and includes a third gear rotatably coupled to a second cavity formed in the fixed aft portion and in engagement with the second plurality of gear teeth of the first hub segment, the second gear assembly further includes a fourth gear fixedly coupled to the first actuation rod and in engagement with the third gear, and rotation of the fourth gear in the first rotational direction via the first actuation rod causes rotation of the first hub segment in the first rotational direction via engagement with the third gear.

In some embodiments, rotation of the second and fourth gears via the first actuation rod in a second rotational direction opposite the first rotational direction causes the first tip and hub segments to rotate in the second rotational direction.

According to a further aspect of the present disclosure, a method comprises arranging a fan duct circumferentially around a central axis, providing a fan comprising a plurality of fan blades that extend radially outward relative to the central axis and that are adapted to rotate about the central axis to force fan exit air toward an aft end of the fan duct, arranging an outlet guide vane assembly in the fan duct axially downstream of the fan and configured to adjust a direction of incoming fan exit air received from the plurality of fan blades and reduce incidence between the outlet guide vane assembly and the fan exit air, the outlet guide vane assembly including a first variable leading edge guide vane that extends radially relative to the central axis and includes a leading edge portion and a fixed aft portion, the leading edge portion including a first tip segment configured to rotate about a leading edge pitch axis and a first hub segment located radially inward of and separate from the first tip segment, the first hub segment configured to independently rotate about the leading edge pitch axis relative to the first tip segment, the first tip segment including a first plurality of gear teeth arranged thereon, the first hub segment including a second plurality of gear teeth arranged thereon, arranging a first actuation assembly relative to the first variable leading edge guide vane, the first actuation assembly including a first actuation rod, coupling a first gear assembly to the first actuation rod, the first gear assembly in engagement with the first plurality of gear teeth arranged on the first tip segment, and selectively coupling a second gear assembly to the first actuation rod radially spaced apart from the first gear assembly, the second gear assembly in engagement with the second plurality of gear teeth arranged on the first hub segment.

The first actuation rod is configured to be selectively rotated so as to rotate the first and second gear assemblies, wherein rotation of the first gear assembly causes rotation of the first tip segment about the leading edge pitch axis to a first pitch angle relative to the incoming fan exit air, and wherein rotation of the second gear assembly causes rotation of the first hub segment about the leading edge pitch axis to a second pitch angle relative to the incoming fan exit air.

These and other features of the present disclosure will become more apparent from the following description of the illustrative embodiments.

DETAILED DESCRIPTION

Figure 1:
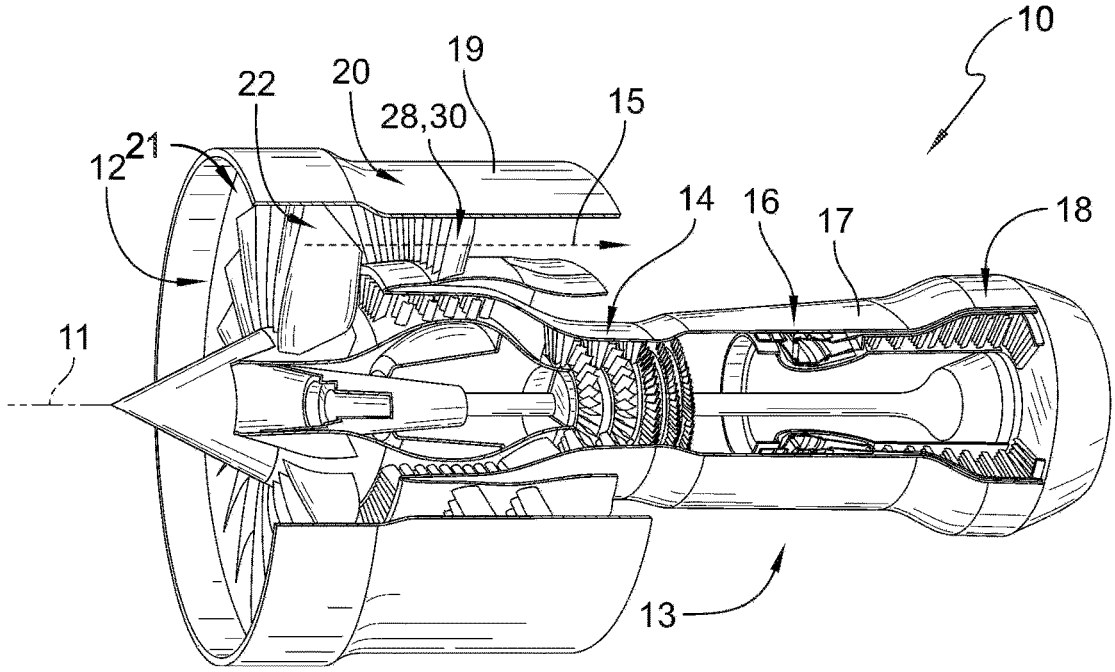
FIG. 1 is a cutaway view of a gas turbine engine that includes a fan assembly having a fan having plurality of fan blades that extend radially outward relative to the central axis, an engine core having a compressor, a combustor, and a turbine, and an outlet guide vane assembly located in a fan duct axially downstream of the plurality of fan blades that is configured to reduce the incidence between the outlet guide vane assembly and the fan exit air received from the fan blades and return the flow to generally axial flow.

For the purposes of promoting an understanding of the principles of the disclosure, reference will now be made to a number of illustrative embodiments illustrated in the drawings and specific language will be used to describe the same.

An illustrative aerospace gas turbine engine 10 includes a fan assembly 12 and an engine core 13 having a compressor 14, a combustor 16, and a turbine 18, as shown in FIG. 1. The fan assembly 12 is driven by the turbine 18 and provides thrust for propelling an air vehicle by forcing fan exit air 15 through a fan duct 20 that circumferentially surrounds an outer casing 17 of the engine core 13. The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 to cause the turbine 18 to rotate about a central axis 11 and drive the compressor 14 and the fan 12. In some embodiments, the fan may be replaced with a propeller, drive shaft, or other suitable configuration.

Figure 2:
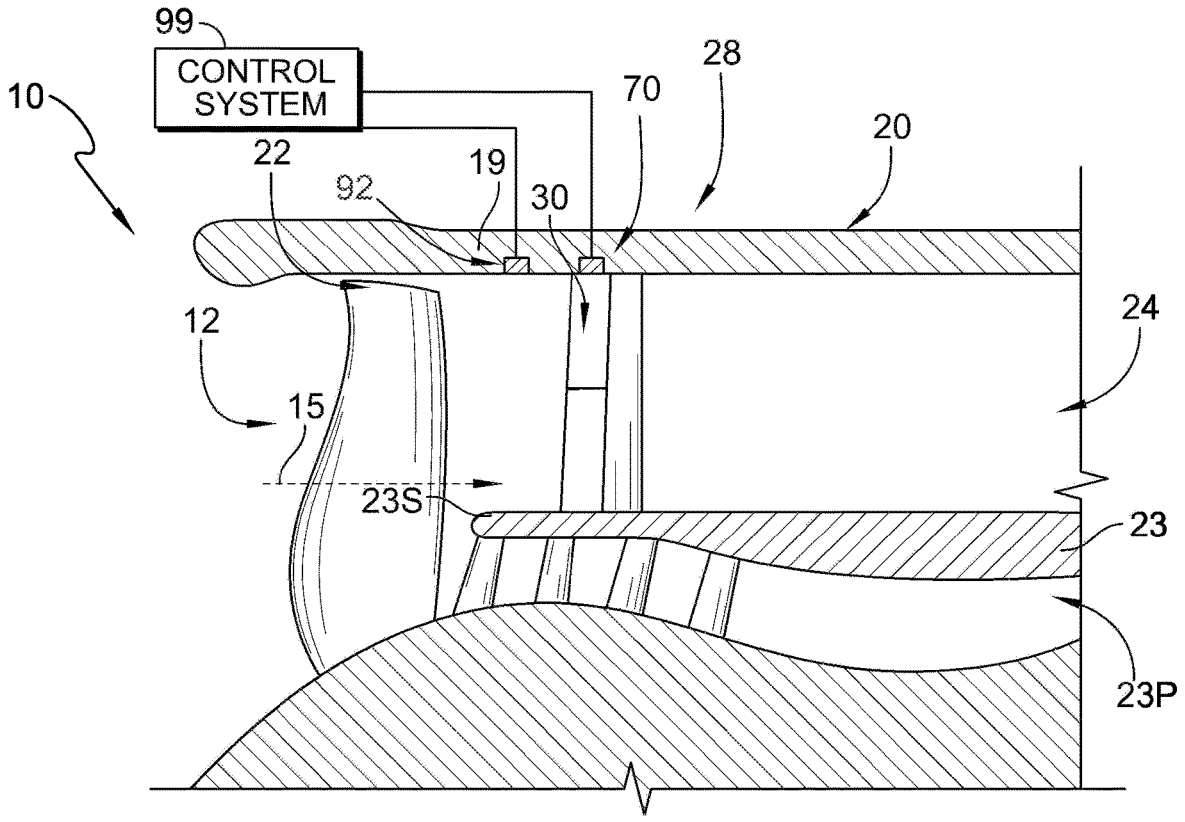
FIG. 2 is a side cross-sectional view of the gas turbine engine of FIG. 1, showing the fan assembly including the plurality of fan blades, showing that the engine further includes an outer casing and an inner wall that define a fan duct passage through which the fan exit air flows, showing that the outlet guide vane assembly includes a first variable leading edge outlet guide vane having a first tip segment and a first hub segment configured to more closely match the vane to distorted fan exit air, and showing that the first tip and hub segments are hinged to each other.

The fan assembly 12 includes a fan 21 having a plurality of fan blades 22 that extend radially outward relative to the central axis 11 and that are located in the inlet of the gas turbine engine 10, as shown in FIGS. 1 and 2. The fan blades 22 direct at least a portion of the air flowing over the blades 22, this portion being fan exit air 15 as shown in FIGS. 1 and 2, through the fan duct 20 such that the fan exit air 15 bypasses the engine core 13 and provides additional thrust for the gas turbine engine 10. The fan duct 20 includes an outer fan duct casing 19 and an inner wall 23 that together define an annular fan duct passage 24 through which the fan exit air 15 flows and subsequently exits the fan duct 20 into the ambient air surrounding the engine 10. The inner wall 23 may include an axially forward end 23S that functions as a splitter such that a portion of the incoming fan exit air 15 enters the engine core through the engine core passage 23P radially inward of the inner wall 23 and a portion of the fan exit air 15 enters the fan duct 20.

Figure 3:
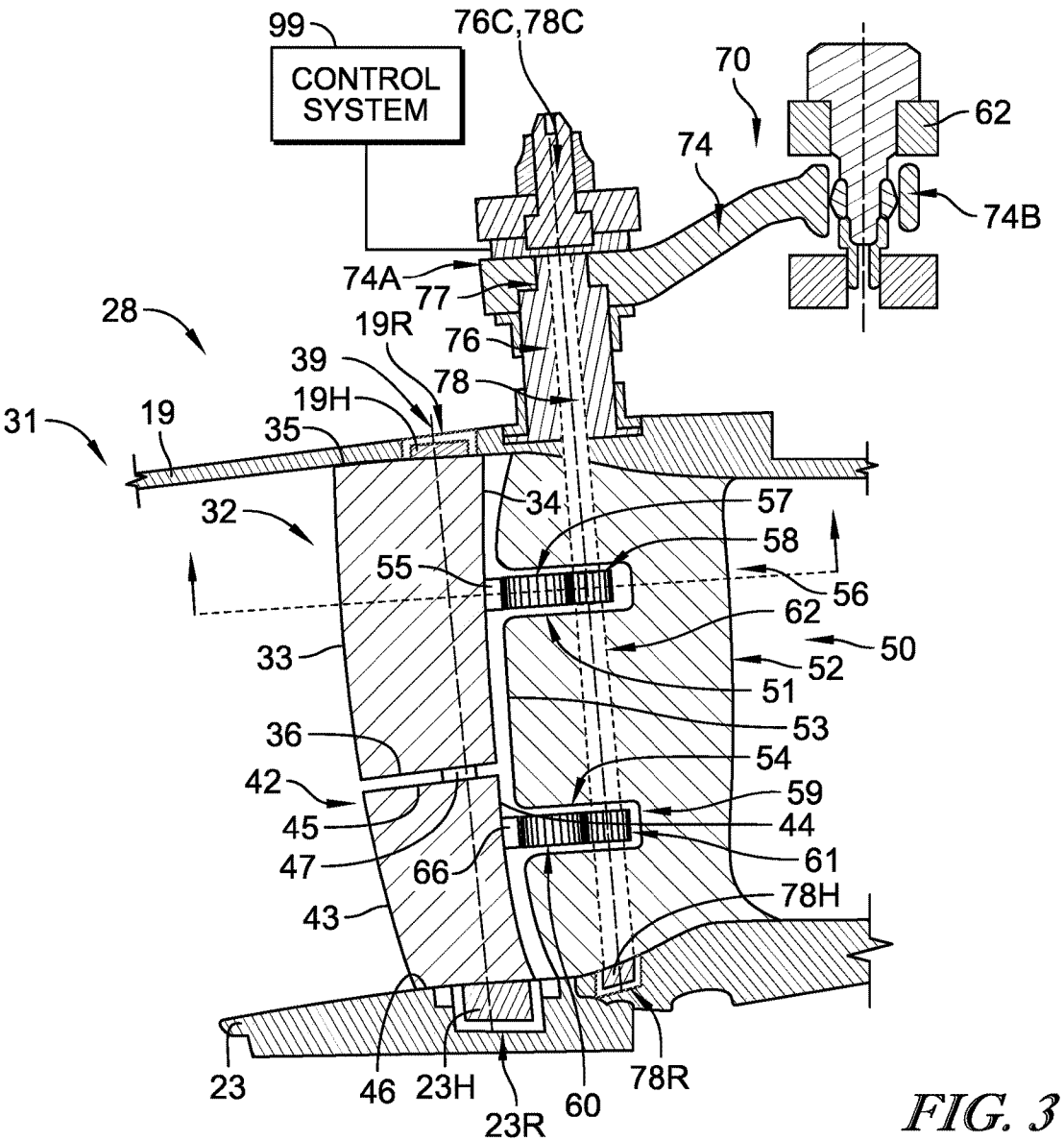
FIG. 3 is a side cross-sectional view of the first variable leading edge outlet guide vane of FIG. 2, showing that the first variable leading edge outlet guide vane includes the first tip segment and the first hub segment, and showing that the outlet guide vane assembly includes a first actuation assembly arranged radially outward of the fixed aft portion and including an actuation rod with two gear assemblies attached thereto and each associated with one of the first tip and hub segments, rotation of the actuation rod causing rotation of the two gear assemblies which causes rotation of the first tip and hub segments.

In the illustrative embodiment, the fan assembly 12 further includes outlet guide vane assembly 28 located in the fan duct 20 axially downstream of the plurality of fan blades 22 that is configured to reduce the incidence between the outlet guide vane assembly 28 and the fan exit air 15 received from the plurality of fan blades 22 and return the flow to generally axial flow, as shown in FIG. 2. In some embodiments, the outlet guide vane assembly 28 is arranged axially downstream of the axially forward end 23S of the inner wall 23. In the illustrative embodiment, the outlet guide vane assembly 28 includes a first variable leading edge outlet guide vane 30 having a leading edge portion 31 and a fixed aft portion 50, as shown in FIG. 3. The leading edge portion 31 includes a first tip segment 32 configured to rotate about a leading edge pitch axis 39 and a first hub segment 42 located radially inward of and separate from the first tip segment 32, also configured to rotate about the leading edge pitch axis 39.

The first variable leading edge outlet guide vane 30 extends radially outward relative to the central axis 11, as shown in FIG. 3. In some embodiments, the first variable leading edge outlet guide vanes 30 may include a plurality of first variable leading edge outlet guide vanes 30 disposed around a circumferential extent of the inner wall 23 define a first outlet guide vane stage.

As shown in FIG. 3 and contextualized in FIGS. 4-7, the first variable leading edge outlet guide vane 30 includes an airfoil shape. The first tip segment 32 includes a leading edge 33 located at a forward end of the segment 32, a trailing edge 34 axially spaced apart from the leading edge 33 and located at an aft end of the segment 32, a radially outer side 35, and a radially inner side 36. Similarly, the first hub segment 42 includes a leading edge 43 located at a forward end of the segment 42, a trailing edge 44 axially spaced apart from the leading edge 43 and located at an aft end of the segment 42, a radially outer side 45, and a radially inner side 46.

Figure 4:
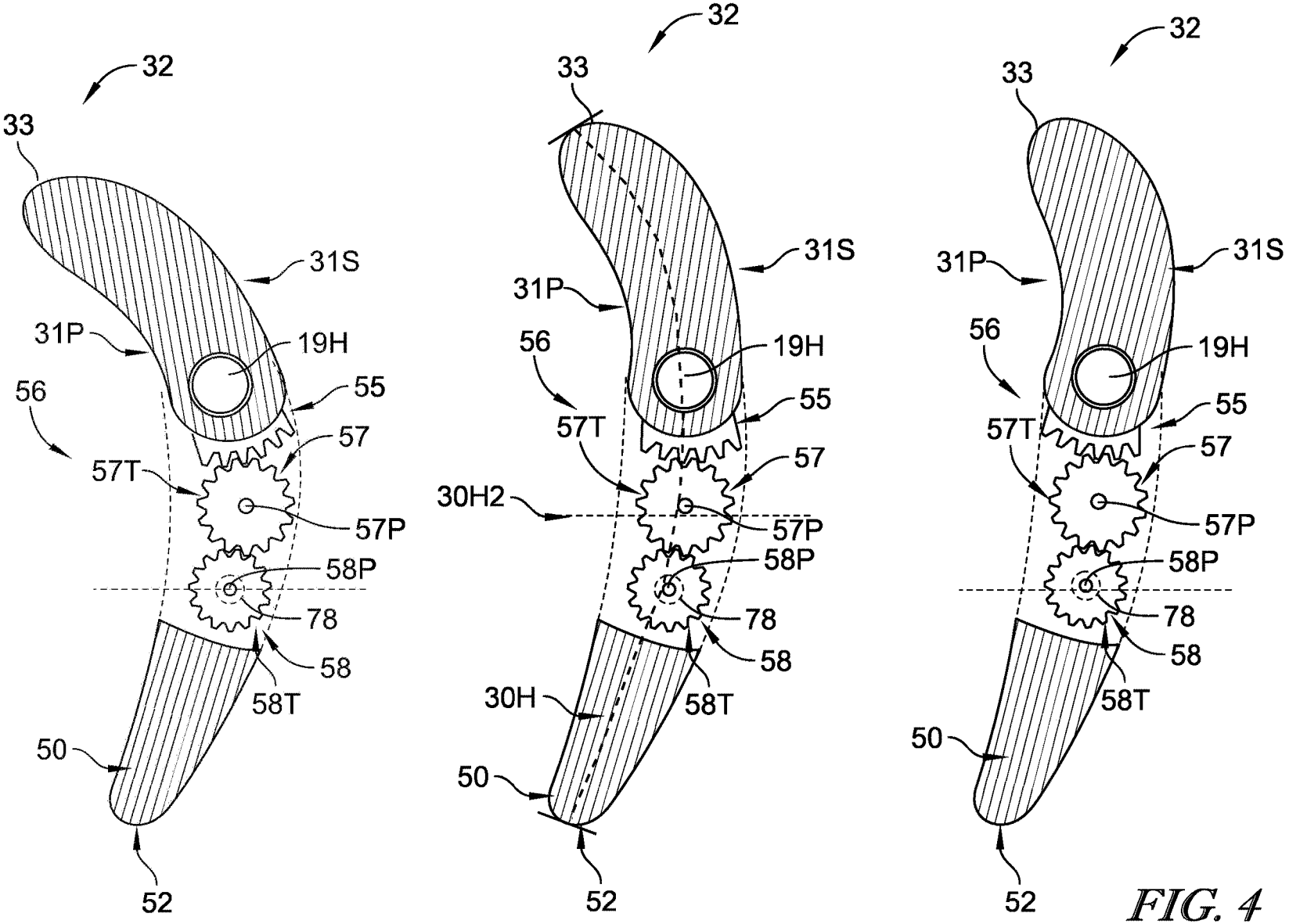
FIG. 4 is a top cross-sectional view of the first tip segment of the outlet guide vane of FIG. 3, showing the first gear assembly and different rotational positions of the first tip segment based on rotation of the first and second gears of the first gear assembly.

Together, the first tip and hub segments 32, 42 form the leading edge portion 31. As shown in FIG. 4, the leading edge portion 31 and the fixed aft portion 50 together form the overall vane 30, which includes a pressure side surface 31P that extends between the leading edges 33, 43 of the segments 32, 42 and a trailing edge 52 of the fixed aft portion 50 on one side of the vane 30. Similarly, a suction side surface 31S extends between the leading edges 33, 43 of the segments 32, 42 and a trailing edge 52 of the fixed aft portion 50 on an opposing side of the vane 30. Illustratively, the leading edge portion 31 is approximately one-third of the total chord length 30H of the vane 30, while the fixed aft portion 50 is approximately two-thirds of the total chord length. In other embodiments, the leading edge portion 31 is approximately one-fourth of the total chord length 30H of the vane 30, while the fixed aft portion 50 is approximately three-fourths of the total chord length 30H. In other embodiments, the leading edge and fixed aft portions 31, 50 are each half the total chord length 30H.

The first tip and hub segments 32, 42 are configured to rotate about the leading edge pitch axis 39, as shown in FIG. 3. In the illustrative embodiment, the leading edge pitch axis 39 is located closer to the trailing edges 34, 44 of the segments 32, 42 than the leading edges 33, 43. In this manner, the first tip and hub segments 32, 42 can rotate proximate to the fixed aft portion 50 such that airflow remains uninterrupted while flowing over the vane 30. In some embodiments, a radially outer hub member 19H of the first tip segment 32 is rotatably coupled to the outer fan duct casing 19 within a radially outer hub receiving recess 19R. Similarly a radially inner hub member 23H of the first hub segment 42 is rotatably coupled to the inner wall 23 within a radially inner hub receiving recess 23R.

The first hub segment 42 is configured to independently rotate about the leading edge pitch axis 39 relative to the first tip segment 32, and may include a small radial gap therebetween. In some embodiments, the first hub segment 42 can include a hinge rod 47 extending radially outwardly from the radially outer side 45 of the first hub segment 42 and rotatably received within the radially inner side 36 of the first tip segment 32 to add stability to the rotation of the two segments 32, 42 relative to each other while allowing for independent rotation. The hinge rod 47 of the first hub segment 42 can be cylindrical and aligned with the leading edge pitch axis 39. In some embodiments in which the first tip and hub segments 32, 42 are formed of a sufficiently stiff material, a hinge rod may be omitted.

As shown in FIGS. 4-7, the first tip and hub segments 32, 42 include first and second pluralities of gear teeth 55, 66 extending away from the axially aft side 34, 44 of the first tip and hub segments 32, 42, respectively. The first and second pluralities of gear teeth 55, 66 are configured to engage with the teeth of the gears of the gear assemblies 56, 59 in order to rotate the first tip and hub segments 32, 42, as will be described below. The number of gear teeth on the first and second pluralities of gear teeth 55, 66, as well as the circumferential extent of the first and second pluralities of gear teeth 55, 66 as measured along the width of the axial aft sides 34, 44, affects the range of pitch angles that the first tip and hub segments 32, 42 can be rotated to. For example, in some embodiments, the first and second pluralities of gear teeth 55, 66 include six gear teeth, as shown in FIGS. 4-7. In some embodiments, the first and second pluralities of gear teeth 55, 66 include between one and five gear teeth. In some embodiments, the first and second pluralities of gear teeth 55, 66 include more than six gear teeth. The more teeth and longer length of the first and second pluralities of gear teeth 55, 66, the larger the range of pitch angles the first tip and hub segments 32, 42 can be rotated to.

To rotate independently, the illustrative embodiment of the outlet guide vane assembly 28 includes a first actuation assembly 70 associated with the first tip and hub segments 32, 42, as shown in FIG. 3. Illustratively, the first actuation assembly 70 includes a first actuation arm 74, a first actuation head 76, and a first actuation rod 78 fixedly coupled to the first actuation head 76 and extending radially. The first actuation assembly 70 further includes a first gear assembly 56 and a second gear assembly 59 selectively coupled to the first actuation rod 78 and spaced apart from each other in the radial direction along the length of the first actuation rod 78. The gear assemblies 56, 59 engage the first and second pluralities of gear teeth 55, 66 so as to rotate the first tip and hub segments 32, 42.

Illustratively, the first actuation arm 74 and the first actuation head 76 are arranged radially outward of the fixed aft portion 50, as shown in FIG. 3. Although the first actuation head 76 is shown in this manner, and the first actuation rod 78 is shown as extending radially inwardly away from the first actuation head 76, one of ordinary skill in the art would understand that the actuation assembly components could be arranged oppositely, in particular having the first actuation head 76 arranged radially inward of the fixed aft portion 50, and thus having the first actuation rod 78 extending radially outwardly away from the first actuation head 76.

In some embodiments, the first actuation arm 74 extending axially away from the first actuation head 76, as shown in FIG. 3. In some embodiments, the first actuation head 76 extends into and is supported by the outer fan duct casing 19 and is fixedly coupled to the first actuation rod 78 which extends radially therefrom. As shown in FIG. 3, the first actuation head 76 is axially offset in the aft direction from the leading edge pitch axis 39. In some embodiments, the actuation rod 78 is arranged closer to the forward side 53 of the fixed aft portion 50 than the trailing edge 52. In particular, the actuation rod 78 is located approximately halfway along the chord length 30H of the vane 30, or slightly offset therefrom. For example, as shown in FIG. 4, the actuation rod 78, which rotates the gear 58 about the pivot axis 58P, is located slightly axially aft of the halfway point 30H2 of the chord length 30H.

In some embodiments, the actuation head 76 is cylindrical having a central axis 76C that aligns with a central axis 78C of the of the first actuation rod 78. The first actuation head 76 is fixedly arranged within an opening 77 formed at a first end 74A of the first actuation arm 74. As a result, pivoting movement of the first actuation arm 74 about the actuation head 76 central axis 76C rotates the first actuation head 76, which in turn rotates the first actuation rod 78. In some embodiments, the first actuation arm 74 is arranged radially outward of the vane 30 and the outer fan duct casing 19, as shown in FIG. 3. In some embodiments, an actuation rod receiving cavity 62 may be formed in the fixed aft portion 50 though which the actuation rod 78 may extend.

As shown in FIG. 3, the first actuation rod 78 is configured to rotate about its central axis 78C, which in turn will rotate the gear assemblies 56, 59. In some embodiments, the first gear assembly 56 includes a first gear 57 rotatably coupled to and within a first cavity 51 formed in the fixed aft portion 50 and in engagement with the first plurality of gear teeth 55 of the first tip segment 32, as shown in FIG. 3. The gear 57 may be rotatable about a pivot point 57P and include gear teeth 57T. The cavity 51 can protrude axially aft from an opening on the axially forward side 53 of the fixed aft portion 50, the opening allowing the teeth 57T of the first gear 57 to protrude therefrom and contact the teeth of the first plurality of gear teeth 55.

The first gear assembly 56 can further include a second gear 58 arranged axially aft of the first gear 57 within the cavity 51, as shown in FIG. 3. The gear 58 may be rotatable about a pivot point 58P and include gear teeth 58T. The second gear 58 is fixedly coupled to the first actuation rod 78 and in engagement with the first gear 57. As a result, rotation of the second gear 58 in a first rotational direction via rotation of the first actuation rod 78 causes rotation of the first tip segment 32 in the first rotational direction via the engagement of the second gear 58 with the first gear 57.

The second gear assembly 59 can include third and fourth gears 60, 61 similarly configured as the first gear assembly 56, the third and fourth gears 60, 61 being radially spaced apart from the first and second gears 57, 58 along the first actuation rod 78, as shown in FIG. 3. In particular, the third gear 60 is rotatably coupled to and within a second cavity 54 formed in the fixed aft portion 50 and in engagement with the second plurality of gear teeth 66 of the first hub segment 42. The gear 60 may be rotatable about a pivot point 60P and include gear teeth 60T. The cavity 54 can protrude axially aft from an opening on the axially forward side 53 of the fixed aft portion 50, the opening allowing the teeth 60T of the third gear 60 to protrude therefrom and contact the teeth of the second plurality of gear teeth 66.

The second gear assembly 59 can further include the fourth gear 61 arranged axially aft of the third gear 60 within the cavity 54, as shown in FIG. 3. The gear 61 may be rotatable about a pivot point 61P and include gear teeth 61T. The fourth gear 61 is fixedly coupled to the first actuation rod 78 and in engagement with the third gear 60. As a result, rotation of the fourth gear 61 in the first rotational direction via rotation of the first actuation rod 78 causes rotation of the first hub segment 42 in the first rotational direction via the engagement of the fourth gear 61 with the third gear 60.

As can be seen in FIGS. 4-7, the cavities 51, 54 are sized so as to contain the gears 57, 58, 60, 61 therein without the gears 57, 58, 60, 61 protruding outwardly beyond the walls of the vane 30. As such, the gears 57, 58, 60, 61 are prevented from interrupting any portion of the air flow over the vane 30. The cavities 51, 54 may be entirely sealed off from the environment via the pressure and suction side 31P, 31S walls, except for where the gear 57, 58, 60, 61 must extend axially forward out of the fixed aft portion 50 and engage the gear teeth 55, 66.

As can be seen in FIGS. 3 and 4, the first gear assembly 56 can include two gears, such as the first and second gears 57, 58, in some embodiments. In other embodiments, a single gear in the first gear assembly 56 could be used to rotate the tip segment 32, although the directionality would be reversed (i.e. the rotation of the actuation rod 78 in the first rotational direction would cause rotation of the first tip segment 32 in an opposing, second rotational direction).

Figure 6:
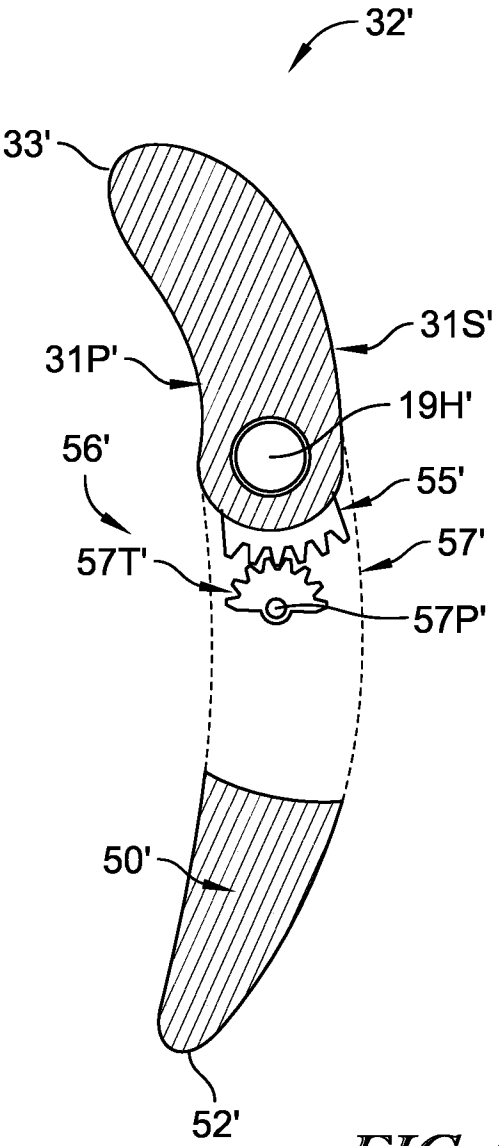
FIG. 6 is a top cross-sectional view of either of the first and second gear assemblies of the outlet guide vane of FIG. 3, showing a gear assembly including a single gear that is a partial gear.

Similarly, a single gear in the second gear assembly 59 could be used to rotate the hub segment 42, although again, directionality would be reversed. For example, as shown in FIG. 6, which is numbered with single prime numbers relative to FIG. 5, the first assembly 56' (which may apply to the second assembly 59' as well) may include a single gear 57', and in some embodiments, a single partial gear 57', as shown in FIG. 6. In some embodiments, more than two gears can be used in one or both of the first and second gear assemblies 56, 59 based on the design requirements of the outlet guide vane assembly 28.

In some embodiments, the second gear 58 can be smaller than and includes fewer teeth than the first gear 57, and the fourth gear 61 is larger than and includes more teeth than the third gear 60. In some embodiments, both the second and fourth gears 58, 61 are smaller than and include fewer teeth than the first and third gears 57, 60. In some embodiments, both the second and fourth gears 58, 61 are larger than and include more teeth than the first and third gears 57, 60, such the configurations of these gears shown in FIG. 5.

In operation in embodiments including two gears for each assembly 56, 59, rotation of the first actuation rod 78 in the first rotational direction rotates the first tip and hub segments 32, 42 in the first rotational direction. Opposingly, rotation of the second and fourth gears 58, 61 via the first actuation rod 78 in the opposite second rotational direction causes the first tip and hub segments 32, 42 to rotate in the second rotational direction.

The amount of rotation of the first tip and hub segments 32, 42, or in other words the range of pitch angles that the first tip and hub segments 32, 42 can be rotated to, is dependent on the configuration of the gears 57, 58, 60, 61, in addition to the number of teeth length of the first and second pluralities of gear teeth 55, 66. For example, a smaller range of pitch angles of the first tip and hub segments 32, 42 can be achieved by utilizing a smaller gear with less teeth, or teeth that are more spaced apart about the circumference of the gear. This would lead to less precise rotation of the first tip and hub segments 32, 42 such that the pitch angle that the first tip and hub segments 32, 42 are movable to based on each per tooth movement of the gear is large. In some embodiments, a larger range of pitch angles of the first tip and hub segments 32, 42 can be achieved by utilizing a larger gear with more teeth, or teeth that are more tightly spaced about the circumference of the gear. This would lead to more precise rotation of the first tip and hub segments 32, 42 such that the pitch angle that the first tip and hub segments 32, 42 are movable to based on each per tooth movement of the gear is smaller.

By selectively arranging specific gears with specific size and tooth configurations, the first tip and hub segments 32, 42 can be individually controlled with respect to each other to the same or differing angles, thus allowing for a multitude of segment positions and arrangements to be achieved. For example, the same sized gears can be used such that the first tip and hub segments 32, 42 are rotated to the same pitch angles when the actuation rod 78 is rotated. In other embodiments, differently sized gears with differing tooth arrangements can be used such that the first tip and hub segments 32, 42 are rotated to different pitch angles when the actuation rod 78 is rotated. For example, the first gear 57 can be larger than and include more teeth than the third gear 60. Conversely, the first gear 57 can be smaller than and include fewer teeth than the third gear 60. This provides for great flexibility in managing incoming airflows which may include distortions and disturbances. This can be particularly useful in embedded engine applications with complex intake and inlet duct geometries. In such scenarios, the distortion flows have more significant gradients and vortices, even in flight, so accommodation is necessary to maintain fan operability and performance.

Figure 5:
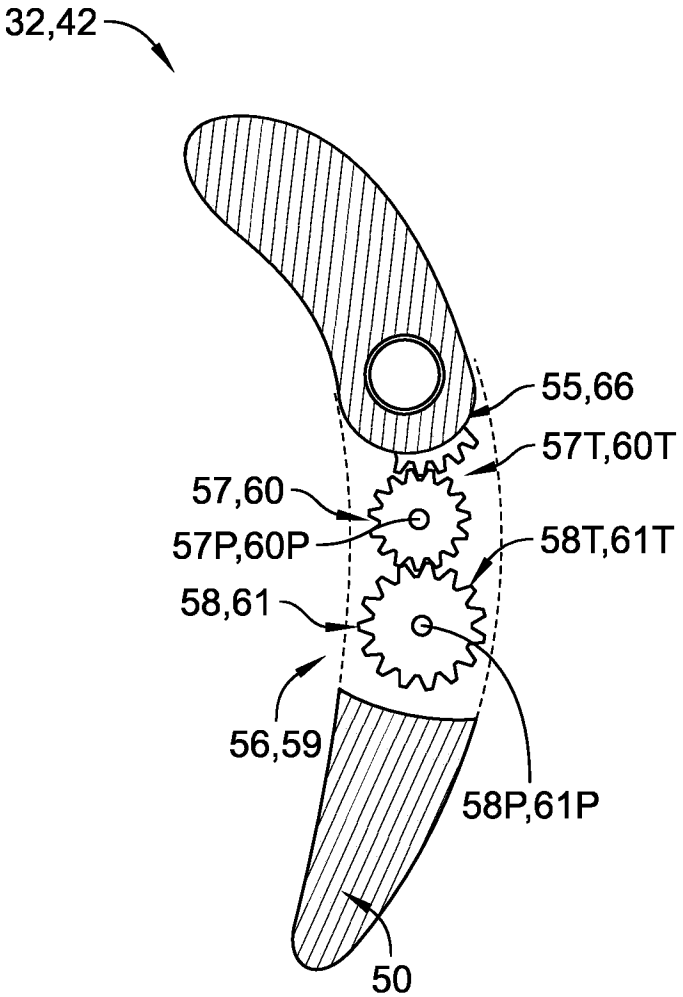
FIG. 5 is a top cross-sectional view of either of the first and second gear assemblies of the outlet guide vane of FIG. 3, showing a gear assembly in which the aft gear is larger than the forward gear.

In some embodiments, such as that shown in FIG. 5, the second and fourth gears 58, 61 can be larger than and include more teeth than the first and third gears 57, 60, and in other embodiments, the second and fourth gears 58, 61 can be smaller than and include fewer teeth than the first and third gears 57, 60.

Figure 7:
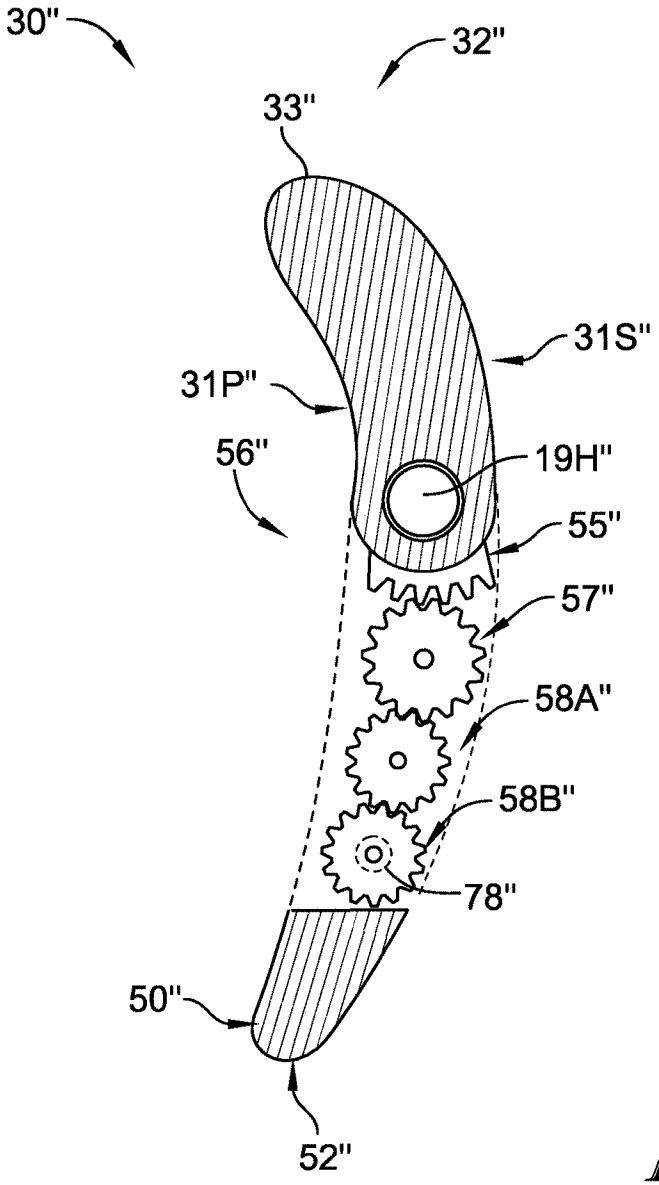
FIG. 7 is a top cross-sectional view of either of the first and second gear assemblies of the outlet guide vane of FIG. 3, showing a gear assembly in which two gears are arranged aft of the forward gear, the two gears being rotatable such that one gear of the two gears can engage the forward gear so as to turn the forward gear in a first rotational direction and the other of the two gears can engage the forward gear so as to turn the forward gear in a second, opposite rotational direction.

In other embodiments, a vane 30" may include an additional gear 58B" that is configured to rotate the first tip segment 32" (although not shown, may also be applicable to the gears associated with the first hub segment) in a direction opposite of other vanes that do not include the additional gear, as shown in FIG. 7. In particular, some vanes of a plurality of vanes 30 may include some vanes 30" having three gears 57", 58A", 58B", as shown in the exemplary embodiment of FIG. 7, while other vanes of the plurality of vanes 30 include some vanes 30 that only include two gears 57, 58. Because the first actuation rod 78" is fixedly coupled to the third, additional gear 58B", the first tip segment 32" will be rotated in the direction opposite of the vanes 30 having only two gears 57, 58 (i.e. reversed). A person skilled in the art will understand that the embodiment including three gears is only exemplary, and that other numbers of gears may be utilized to effectuate rotation of the segments 32, 42 in differing directions (i.e. some vanes 30 including one gear while others include two gears, and similar combinations).

With regard to the first actuation assembly 70 described above, the first actuation arm 74 is configured to be moved generally circumferentially relative to the first actuation head 76 by annular rings (such as annular ring 62 shown in FIG. 3 and FIG. 8A), segmented annular rings, or individual actuators so as to pivot the actuation arm 74 about the actuation head 76 central axis 76C. In particular, the actuation arm 74 may be selectively pivoted about the actuation head 76 central axis 76C so as to rotate the first actuation rod 78 which rotates the first and second gear assemblies 56, 59 which rotates the first tip and hub segments 32, 42. As a result, the first tip segment 32 can be selectively rotated about the leading edge pitch axis 39 to a first pitch angle relative to the incoming fan exit air 15. Similarly, the first hub segment 42 can be selectively rotated about the leading edge pitch axis 39 to a second pitch angle or the same first pitch angle relative to the incoming fan exit air 15. The fixed trailing edge 50 rotates any flow back to near axial to minimize loss from swirl.

Figure 8A:
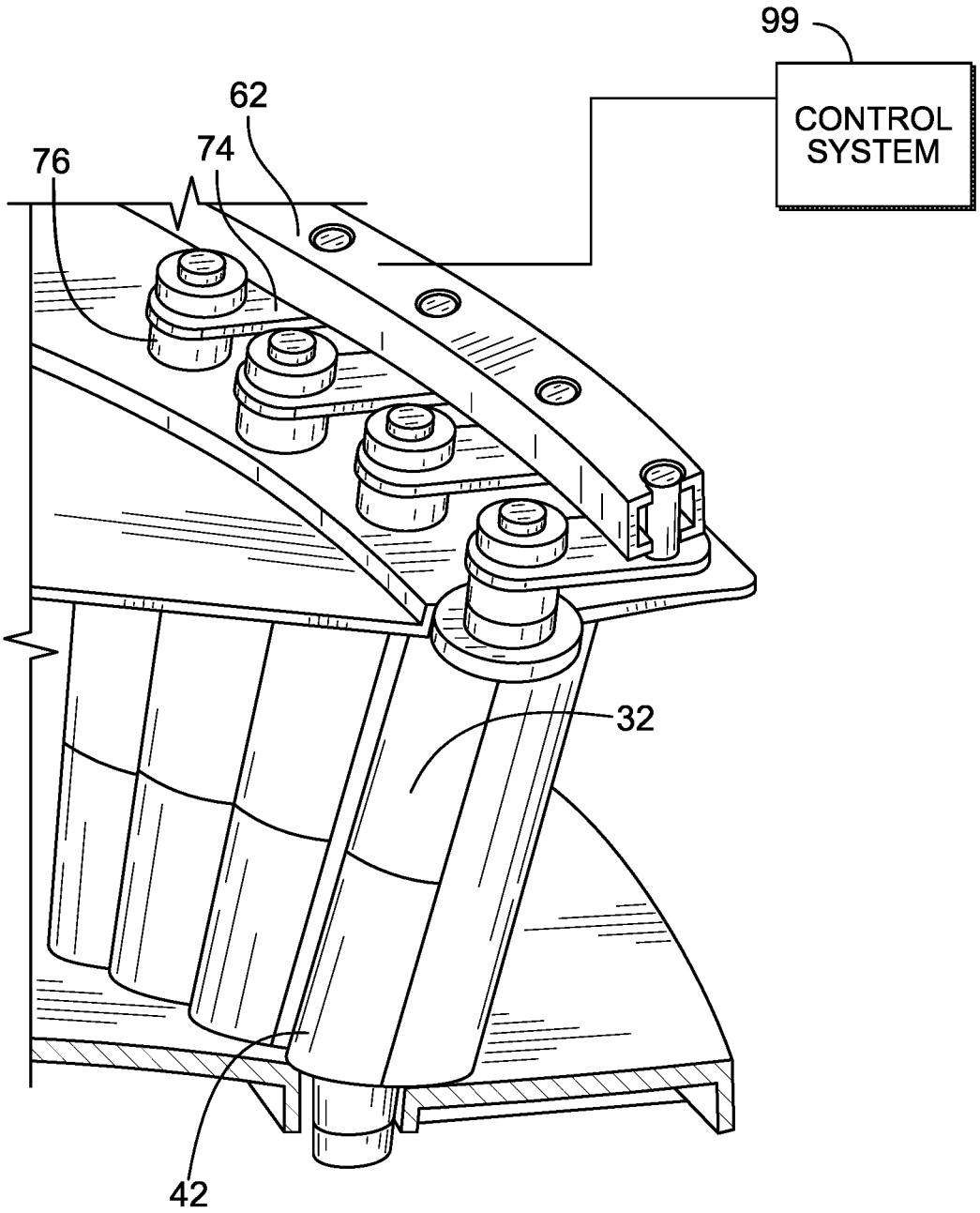
FIG. 8A is a side cutaway perspective view of a plurality of the first variable leading edge outlet guide vanes of FIG. 3, showing that the first actuation heads are connected to a full annular ring via actuation arms.
Figure 8B:
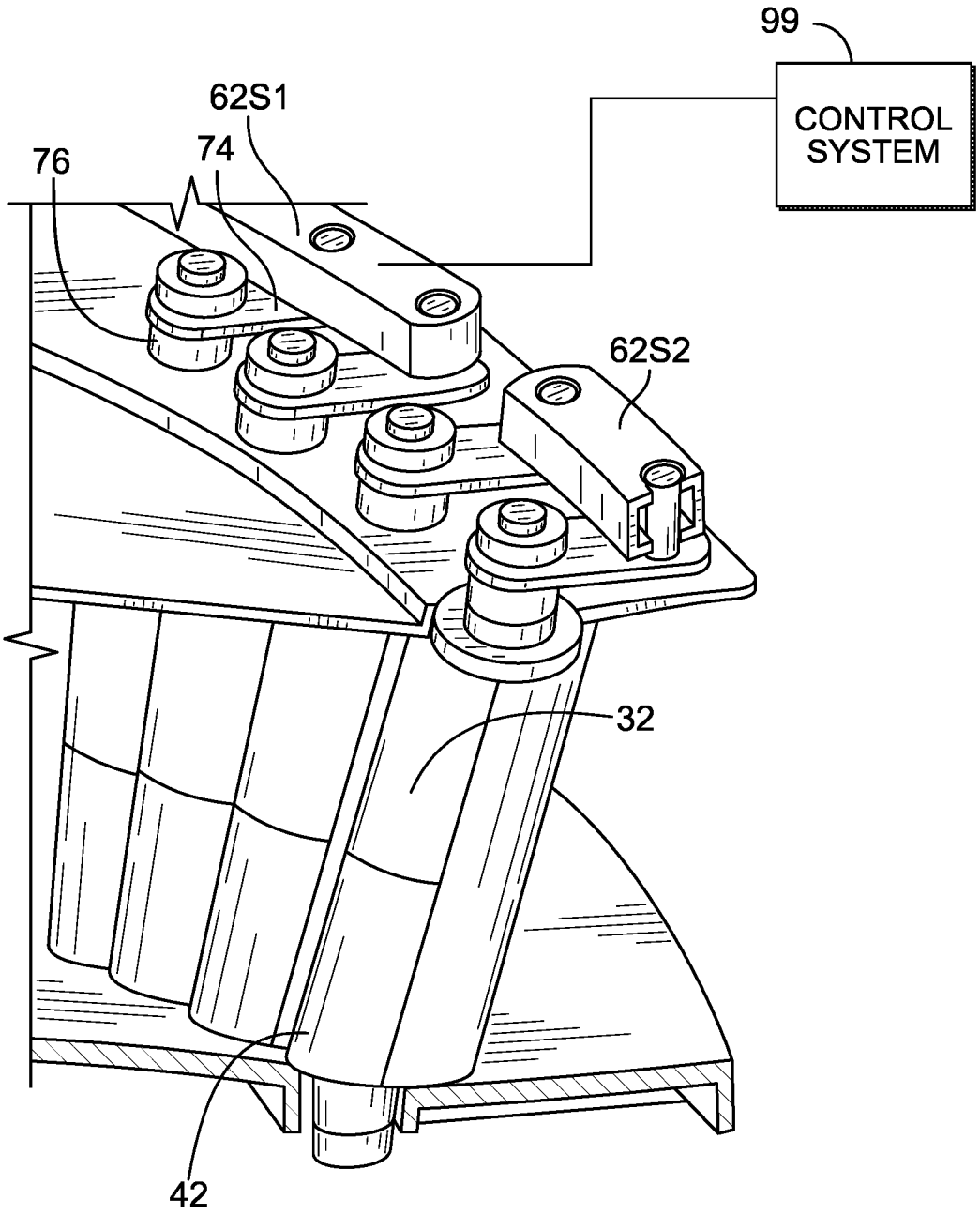
FIG. 8B is a side cutaway perspective view of a plurality of the first variable leading edge outlet guide vanes of FIG. 3, showing that two groups of first actuation heads are connected to annular ring segments via actuation arms, the segments being spaced apart circumferentially.
Figure 8C:
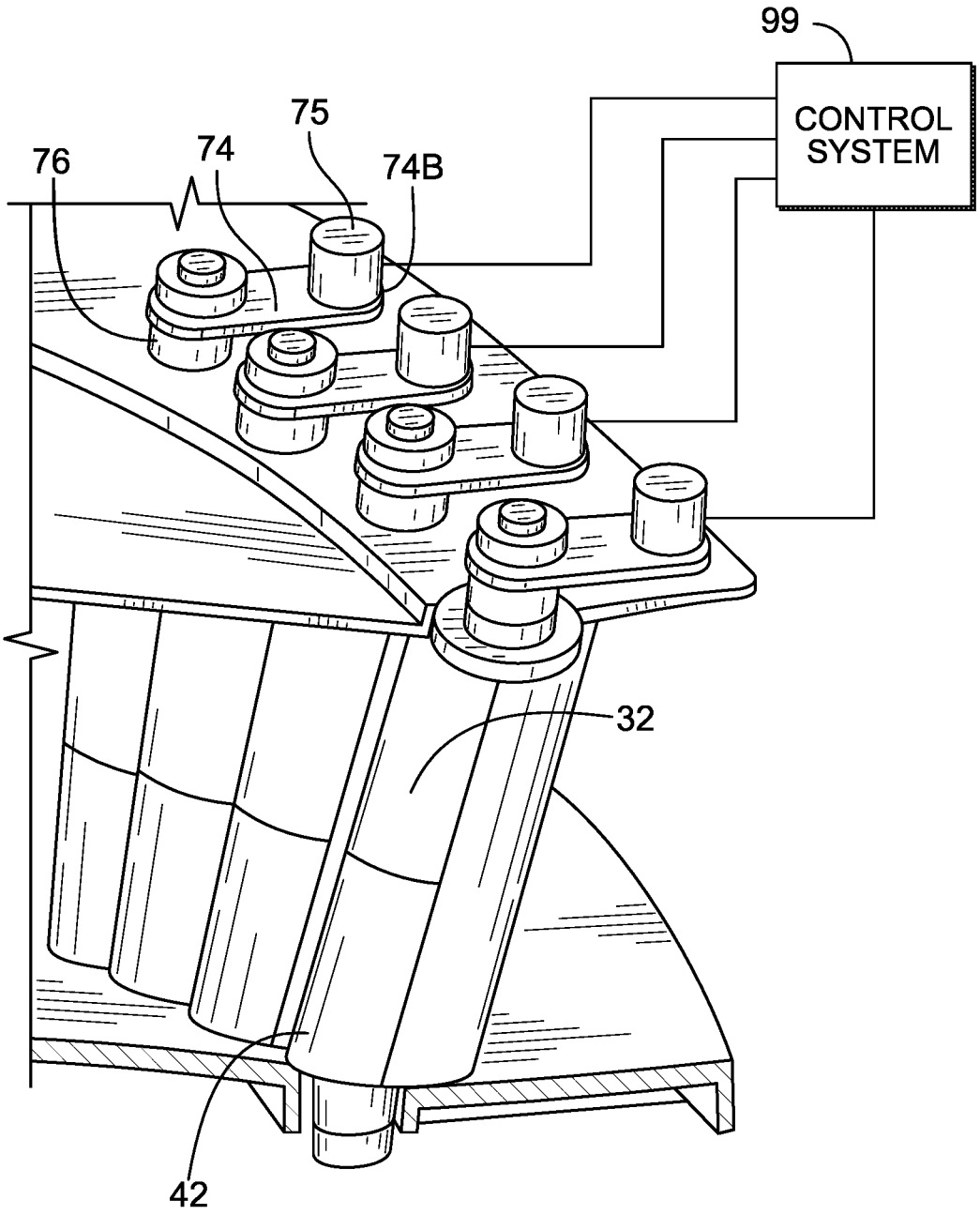
FIG. 8C is a side cutaway perspective view of a plurality of the first variable leading edge outlet guide vanes of FIG. 3, showing that the first actuation heads are each connected to individual actuators, which are connected to a control system.

As shown in FIG. 3, and in greater detail in FIGS. 8A, 8B, 8C, the outlet guide vane assembly 28 can further include a plurality of variable leading edge outlet guide vanes 30 arranged around the entirety of the circumferential extent of the vane assembly 28. The plurality of variable leading edge outlet guide vanes 30 include the first variable leading edge outlet guide vane 30 described above. Each variable leading edge outlet guide vane 30 of the plurality of variable leading edge outlet guide vanes 30 includes a respective tip segment 32 and hub segment 42, as well as the actuation assembly 70. The first actuation arms 74 of each vane 30 may be coupled to an annular ring (for example, first annular ring 62) that extends circumferentially about the central axis 11. The actuation arm 74 may be coupled to the ring 62 via an opening formed at a second end 74B of the actuation arm 74.

As can be seen in FIG. 8A, the outlet guide vane assembly 28 may include a fully annular first annular ring 62. In this configuration, the first annular ring 62 can be configured to rotate about the central axis 11 so as to move the actuation arm 74 coupled thereto generally circumferentially relative to the first actuation head 76, or in other words, to pivot the actuation arm 74 coupled thereto about the actuation head 76 central axis 76C. As a result, the rotation of the first annular ring 62 about the central axis 11 causes the first actuation rod 78 to rotate, thus causing the first and second gear assemblies 56, 59 to rotate, thus causing rotation of the first tip and hub segments 32, 42, respectively. As will be described in detail below, the annular ring 62 may be controlled by a control system 99.

In some scenarios, it may be beneficial to have more control over individual sections of the plurality of variable leading edge outlet guide vanes 30 or individual vanes 30. This may be particular useful when the engine experiences more significantly distorted flows, such as in embedded engine applications. Sectional control or individual control would provide additional flexibility to accommodate as much flow variation as possible to recover operability and performance margins. For example, as an aircraft maneuvers through ground crosswind or variations of flight orientations such as sideslip and pitch variations, the plurality of variable leading edge outlet guide vanes 30 can be rotationally moved in sections or independently to best reset the inlet angles and maximize the fan operability envelope. The optimized rest of the inlet angles improves stall margin, improves efficiency and performance, and reduces fan forcing debits.

As can be seen in FIG. 8B, first annular ring 62 may be broken up into segments so as to include multiple circumferential segments disposed about the central axis 11. In particular, the multiple circumferential segments are radially aligned with each other and circumferentially spaced apart. For example, the assembly 28 may include a first annular ring segment 62S1 and a second annular ring segment 62S2 radially aligned with the first annular ring segment 62S1, extending partially circumferentially about the central axis 11, and circumferentially offset from the first annular ring segment 62S1.

In this configuration, the first and second annular ring segments 62S1, 62S2 can be configured to independently rotate about the central axis 11 so as to move each actuation arm 74 coupled thereto generally circumferentially relative to the first actuation head 76, or in other words, to pivot each actuation arm 74 coupled thereto about the actuation head 76 central axis 76C. The first and second annular ring segments 62S1, 62S2 are circumferentially spaced apart a great enough distance to allow maximum movement relative to each other. For example, in some scenarios, the first annular ring segment 62S1 may be moved in an opposing circumferential direction to the second annular ring segment 62S2 such that the respective tip segments 32 of their associated vanes 30 are rotated in opposing rotational directions.

The outlet guide vane assembly 28 can include multiple annular ring segments similar to the segments 62S1, 62S2 disposed around the entire circumferential extent of the assembly 28. As such, the multiple annular ring segments can define groups of vanes 30, the tip and hub segments 32, 42 of each being able to be rotated to unique pitch angles based on the circumferential movement and position of their respective annular ring segment. As will be described in detail below, the annular ring segments 62 may be controlled by a control system 99.

In some embodiments, the control system 99 is configured to rotate each segment 32, 42 of each vane 30 of the first plurality of variable leading edge outlet guide vanes 30 individually relative to each other vane's 30 segments 32, 42, as shown in FIG. 6. That is to say, each segment 32, 42 of each vane 30 may be rotated without moving any of the other vanes' segments 32, 42 of the first and second plurality of variable leading edge outlet guide vanes 30. This allows for the vanes 30 to be controlled in a variety of configurations. For example, a group of the plurality of variable leading edge outlet guide vanes 30 may be controlled to be rotated in unison and rotated to a first pitch angle, while other vanes 30 are individually controlled, each to unique pitch angles. The individual controllability of the vanes 30 accounts for variations in the fan exit air 15 around the circumference of the area of the plurality of variable leading edge outlet guide vanes 30, which is particularly beneficial for the reasons discussed above.

In another example, if the rotation of the first plurality of guide vanes 30 causes more undesirable flow effects in certain circumferential sectors, only vanes 30 located in those certain circumferential sectors may be rotated to specific pitch angles to reduce losses from said flow effects, while other vanes 30 may be rotated to different pitch angles. Then, if the flow dynamically encounters different distortions during operation, different circumferential sectors may require vane 30 adjustment. The individual controllability allows for the option to adjust these different circumferential sectors dynamically.

In order to carry out the individual control, the second end 74B of the actuation arm 74 may include a control member 75 coupled to an external actuator (not shown) that moves the actuation arm 74 generally circumferentially relative to the first actuation head 76, as shown in FIG. 8C. In other embodiments, the first actuation head 76 may be individually actuated via an actuator coupled directly to the actuation head 76, for example an actuator coupled to a radially outer side of the first actuation head 76.

As touched on above, by controlling at least one vane 30 of the plurality of variable leading edge outlet guide vanes 30, the control system 99 is configured to control at least some of the flow of the fan exit air 15 after it passes over and exits the fan blades 22. By controlling the entirety of the plurality of variable leading edge outlet guide vanes 30, the control system 99 can accommodate the overall flow of the fan exit air 15, in particular distorted flow, after it passes over and exits the fan blades 22 in order to control fan blade 22 response to forces acting on the fan blades 22, as well as to reduce losses created by undesirable variations in the air flow. Moreover, because the fan exit air 15 may not be uniform as it exits the fan blades 22, the plurality of variable leading edge outlet guide vanes 30 or the axial passage between the vanes 30 and the fan blades 22 operate further from their ideal design conditions. By adjusting the plurality of variable leading edge outlet guide vanes 30, parameters such as incidence are improved, and detrimental flow conditions and losses in the vanes 30 or the axial passage between the vanes 30 and the fan blades 22 such as vortices and stall are reduced.

In some embodiments, the control system 99 is configured to rotate the segments 32, 42 of each vane 30 of the first plurality of variable leading edge outlet guide vanes 30 to pitch angles in response to the gas turbine engine 10 operating at a given operating condition so as to reduce the incidence between the outlet guide vane assembly 28 and the fan exit air 15 received from the plurality of fan blades 22 and redirect the fan exit air 15 in a first direction, in particular a generally axial direction. In particular, the operating condition in which the fan assembly 12 and gas turbine engine 10 are operating in may include at least one of take-off, climb, cruise, descent, landing, and aircraft maneuvers of an aircraft having the engine 10 equipped. In each of these operating conditions, the plurality of fan blades 22 and/or the vanes 30 of the fan assembly 12 may experience various undesirable operability issues such as forcing, stall, and flutter. For example, the engine 10 may operate in particular speed ranges for each of the operating conditions, and as result, the fan blades 22 may experience greater or lower levels of forcing, stall, and/or flutter in response to the engine 10 operating in particular speed ranges.

In order to compensate for these forces acting on the fan blades 22, the control system 99 is configured to rotate the first plurality of variable leading edge outlet guide vanes 30, in particular the segments 32, 42, to an arrangement of pitch angles in order to reduce the incidence between the outlet guide vane assembly 28 and the fan exit air received from the fan blades 22 and return the flow to generally axial flow. This reduction in the incidence between the outlet guide vane assembly 28 and the fan exit air received from the fan blades 22 can improve the operating range of the fan blades 22 relative to forcing, stall, and/or flutter. Moreover, the control system 99 is configured to reset a desired incidence of air flow into the first plurality of variable leading edge outlet guide vanes 30 in response to swirl in the inlet flow. This produces an averaging effect that improves engine performance and efficiency. These arrangements of the vanes 30 can also recover the losses created by flow separation, flow distortions, vortices, and/or swirl.

The control system 99 is operable to control the first plurality of variable leading edge outlet guide vanes 30 in a variety of configurations and arrangements in order to compensate for inlet pressure distortion, vortices and swirl, thus reducing the forcing, stall, flutter, flow separation, and any other undesirable effects in the fan rotor or outlet vanes. For example, in some embodiments, the control system 99 is configured to rotate each vane 30 of the first plurality of guide vanes 30 in unison. In other words, all of the segment 32, 42 of the first plurality of guide vanes 30 move to the same pitch angle. In such embodiments, the each segment 32, 42 of the vane 30 may be mechanically connected to each other via the first and second annular rings 162, 164.

In some embodiments, the control system 99 is configured to rotate at least two different groups of variable leading edge outlet guide vanes 30. For example, the control system 99 may be configured to selectively rotate each group of vanes 30 to create non-uniform backpressure that drives the fan inlet distortion flows within the fan to change or redistribute around the circumference of the fan. This locally reduces loading on fan blades 22 within a lip separated flow with low local pressure to reduce forcing and/or improve the uniformity of flow in general through the fan to reduce forcing. In particular, fully opening (allowing full flow through the guide vanes) at least one group of vanes 30 and fully closing at least one further group of vanes 30 (allowing no flow through the guide vanes) reduces a tendency for a local stall of the fan blades 22 that could lead to early overall stall in the fan. In some embodiments, the control system 99 is configured to rotate a large group of vanes 30 which counters bulk swirling flows or local changes to improve localized intake swirl gradients to improve fan performance and operability.

In at least one additional embodiment, the plurality of variable leading edge outlet guide vane 30 are broken into unique groups of vanes 30, as shown in FIG. 8B. Each group of vanes 30 is mechanically connected to each other, or ganged, via a unique circumferentially extending annular ring segment, such as the annular ring segments 62S1, 62S2 shown in FIG. 8B. Although the illustrative embodiment shows each group of vanes 30 including two vanes 30, the vanes 30 may be grouped and ganged in any combination of at least two groups of vanes totaling at least one fewer vane than the total number of vanes 30 in the plurality of outlet guide vanes 30. For example, if the first plurality of outlet guide vanes 30 includes 60 vanes, a first group may include 30 vanes and a second group may include 30 vanes. As a further non-limiting example, a first group of vanes may include 50 vanes, a second group of vanes may include five vanes, and a third group of vanes may include five vanes.

In some embodiments, the first plurality of variable leading edge outlet guide vanes 30 includes a first group of tip and/or hub segments 32, 42 of first vanes 30 and a second group of tip and/or hub segments 32, 42 of first vanes 30 different from the first group of guide vanes 30. The control system 99 is configured to rotate the first group of tip and/or hub segments 32, 42 of first vanes 30 to a first angles and the second group of tip and/or hub segments 32, 42 of first vanes 30 to a second angle that is different from the first angle. The groups of vanes 30 may be individually controlled or each group may be ganged together. For example, in some embodiments, one half of the first plurality of outlet guide vanes 30 is the first group and the other half of the first plurality of outlet guide vanes 30 is the second group.

In some embodiments, the control system 99 utilizes predetermined arrangements of the plurality of variable leading edge outlet guide vanes 30 that are based on predetermined measurements and data taken in predetermined engine operating conditions and predetermined airflow characteristics. As such, the control system 99 is configured to rotate the vanes 30 to specific predetermined arrangements based on the operating condition and/or airflow characteristic(s) of the fan exit air 15 or the inlet air that the engine 10 and fan assembly 12 are operating in, or based on projected operating conditions and/or airflow characteristic(s) that will be encountered by the engine 10 during a mission.

In some embodiments, the predetermined arrangements of the plurality of variable leading edge outlet guide vanes 30 can be based on previously acquired test data corresponding to specific flight conditions. In a more complex arrangement, the control system 99 could be coupled to measurement systems, such as the at least one sensor 92 described below, that detect flow instabilities associated with impending fan stall to direct vane geometry changes to extend margins. The control system 99 may be more effective near stall as the vanes 30 can redistribute flow conditions to minimize local stall cells. Having smaller ganged vane 30 groups are efficient as well in that such groups only reduce losses locally to extend operability and performance.

In some embodiments, the control system 99 includes at least one sensor 92 configured to take real-time measurements of the air flow within the fan duct passage 24 and of forces acting on the fan assembly components, as shown in FIG. 2. The real-time measurements may be utilized in order to determine the operating condition and/or airflow characteristic(s) of the fan exit air 15 or the inlet air that the engine 10 and fan assembly 12 are operating in so as to inform the control system 99 to which predetermined arrangement to rotate the plurality of variable leading edge outlet guide vanes 30.

In some embodiments, the control system 99 includes a neural network configured to perform machine learning such that the control system 99 can iterate over the predetermined arrangements in order to calculate new arrangements that are applicable to new variations in the operating condition and/or airflow characteristics that are unaccounted for by the predetermined settings and arrangements.

In some embodiments, the control system 99 further includes a subsystem control that is integrated with other engine controls to further control reduction of losses created by undesirable variations in the air flow and improve engine performance and efficiency. For example, if rotation of vanes 30 resulted in a fan flow drop, the subsystem control is configured to compensate for this by increasing the fan speed in order to maintain thrust, and/or by changing the exhaust area of the engine 10 in order to further reduce the losses and improve engine efficiency.

In some embodiments, the at least one sensor 92 may be located proximate to the fan blades 22, proximate to the plurality of variable leading edge outlet guide vanes 30, or both, as shown in FIG. 2. In some embodiments, the sensor or sensors 92 are located in the outer casing 19 radially outward of the fan blades 22 and vanes 30. The at least one sensor 92 may include one of or a combination of dynamic sensors, static wall pressure sensors, altitude sensors, sensors configured to detect the angle of attack of the plurality of fan blades 22, sensors configured to detect the tip timing of the plurality of fan blades 22, and airspeed sensors. In some embodiments, the sensor 92 may be a dynamic pressure transducer. The sensor 92 may also be a sensor configured to measure a rotational speed of the fan blades 22, which could be used along with an additional sensor that is a dynamic pressure transducer.

In the illustrative embodiment, the functionality of the control system 99 described herein may be implemented in various processing and computing devices, and may be located within the engine 10 or outside of the engine 10. Moreover, the functionality may be configured to operate on executable software provided on the processing and computing devices.

Furthermore, the functionality disclosed herein may be implemented in various configurations using computer-readable media for carrying or having computer-executable instructions or data structures stored thereon. Such computer-readable media can be any available media that can be accessed by a general purpose or special purpose computer. By way of example, and not limitation, such computer-readable media can comprise physical storage and/or memory media such as RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer. Computer-executable instructions comprise, for example, instructions and data which cause a general purpose computer, special purpose computer, or special purpose processing device to perform a certain function or group of functions.

Figure 9:
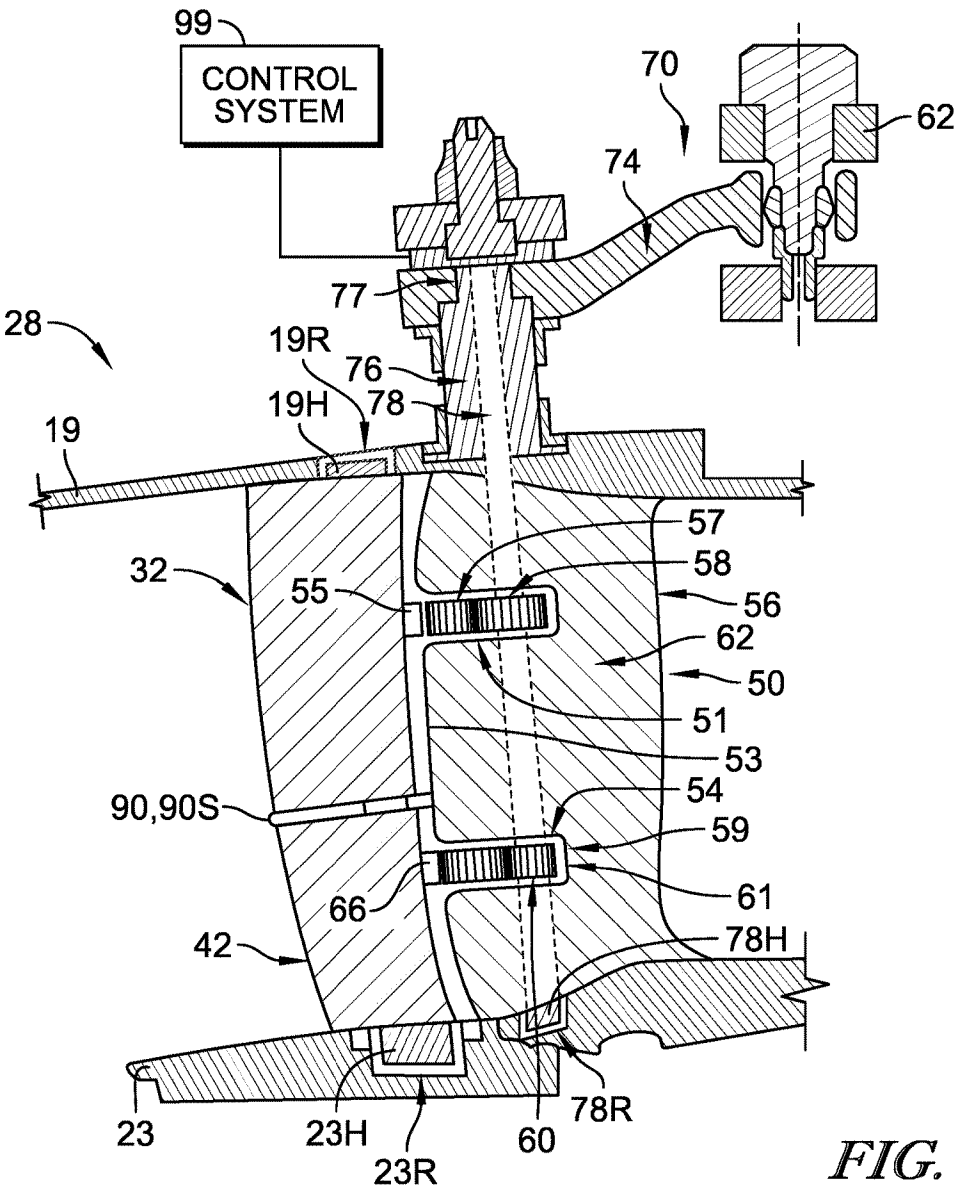
FIG. 9 is a side cross-sectional view of the outlet guide vane of FIG. 3, showing that the guide vane can further include a first air manipulating member arranged radially between the first tip segment and the first hub segment.

As shown in FIG. 9, an air manipulating member 90 may be arranged in the small radial gap between the first tip and hub segments 32, 42. In particular, in some embodiments, the air manipulating member 90 may be configured as a winglet 90 or platform coupled to an axially forward side 53 of the fixed aft portion 50. In other embodiments, the air manipulating member 90 may be configured as a seal 90S coupled to the axially forward side 53 of the fixed aft portion 50, or may be directly coupled to one of the sides 36, 45 of the tip and hub segments 32, 42.

Figure 10:
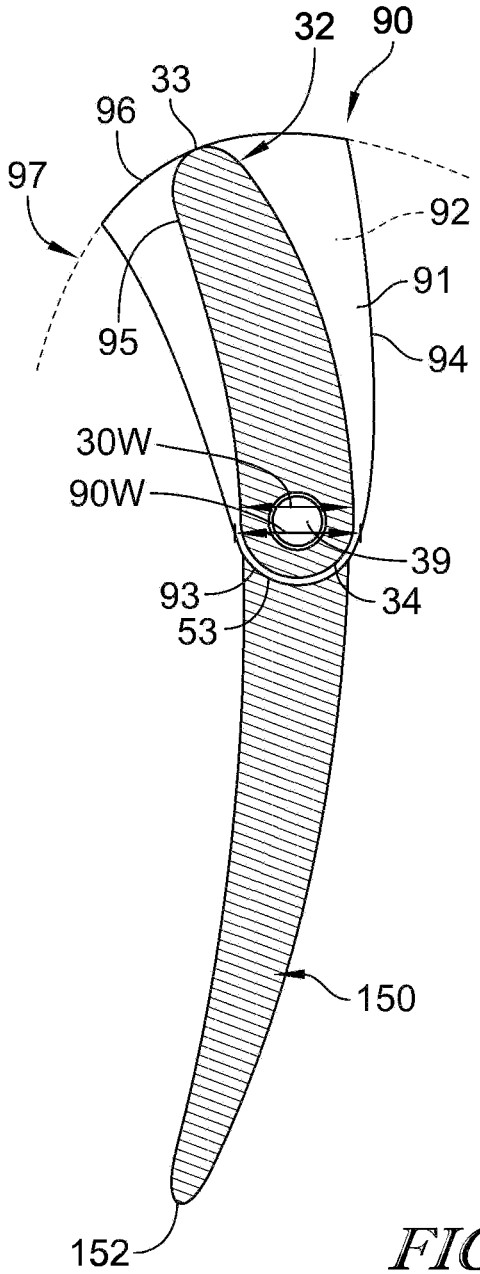
FIG. 10 is a top cross-sectional view of the outlet guide vane of FIG. 11, showing the first tip segment at a neutral position and a top view of the first air manipulating member configured as a winglet.
Figure 11:
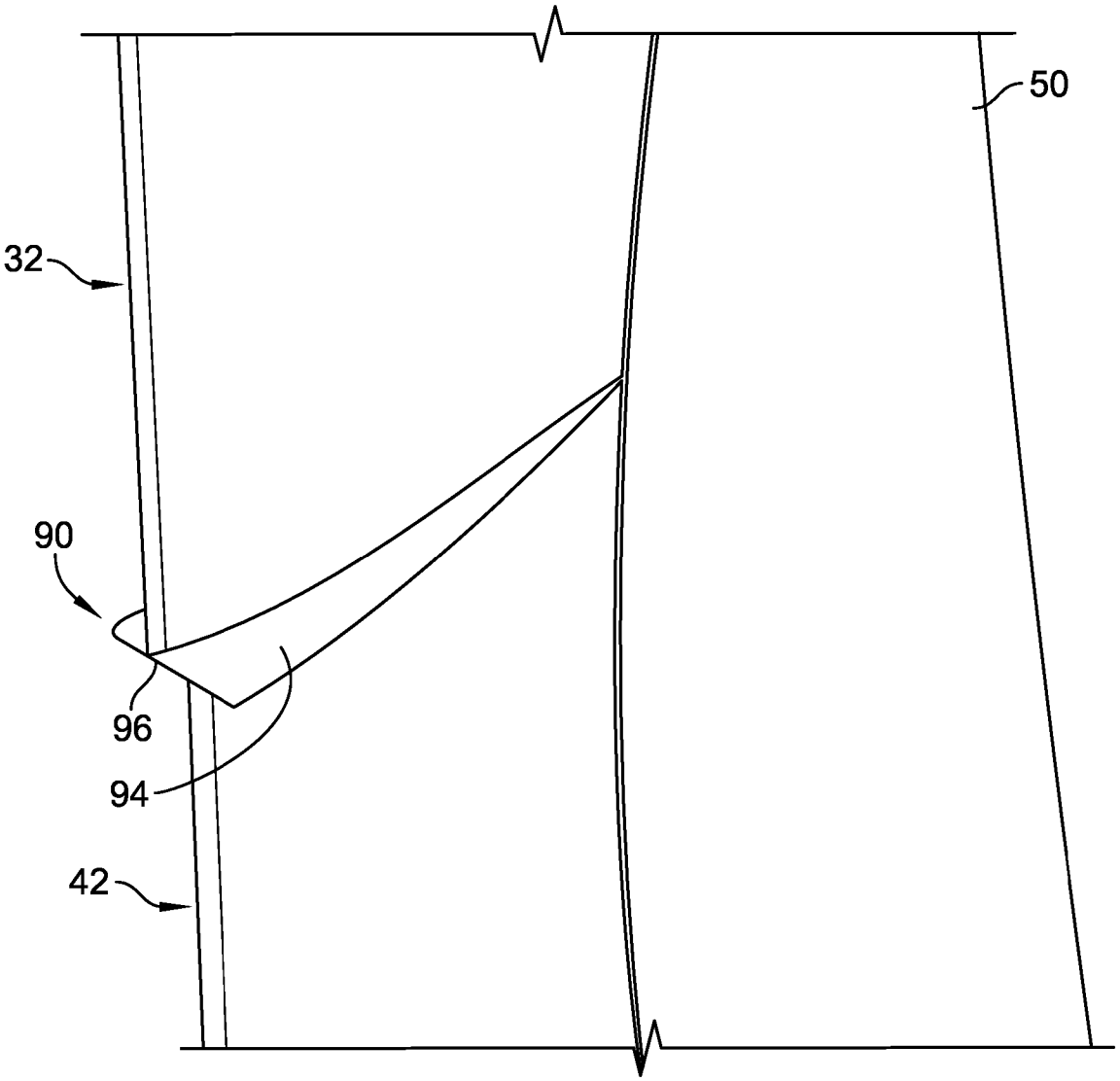
FIG. 11 is a perspective view of the outlet guide vane of FIG. 9, showing the first air manipulating member configured as a winglet.
Figure 12:
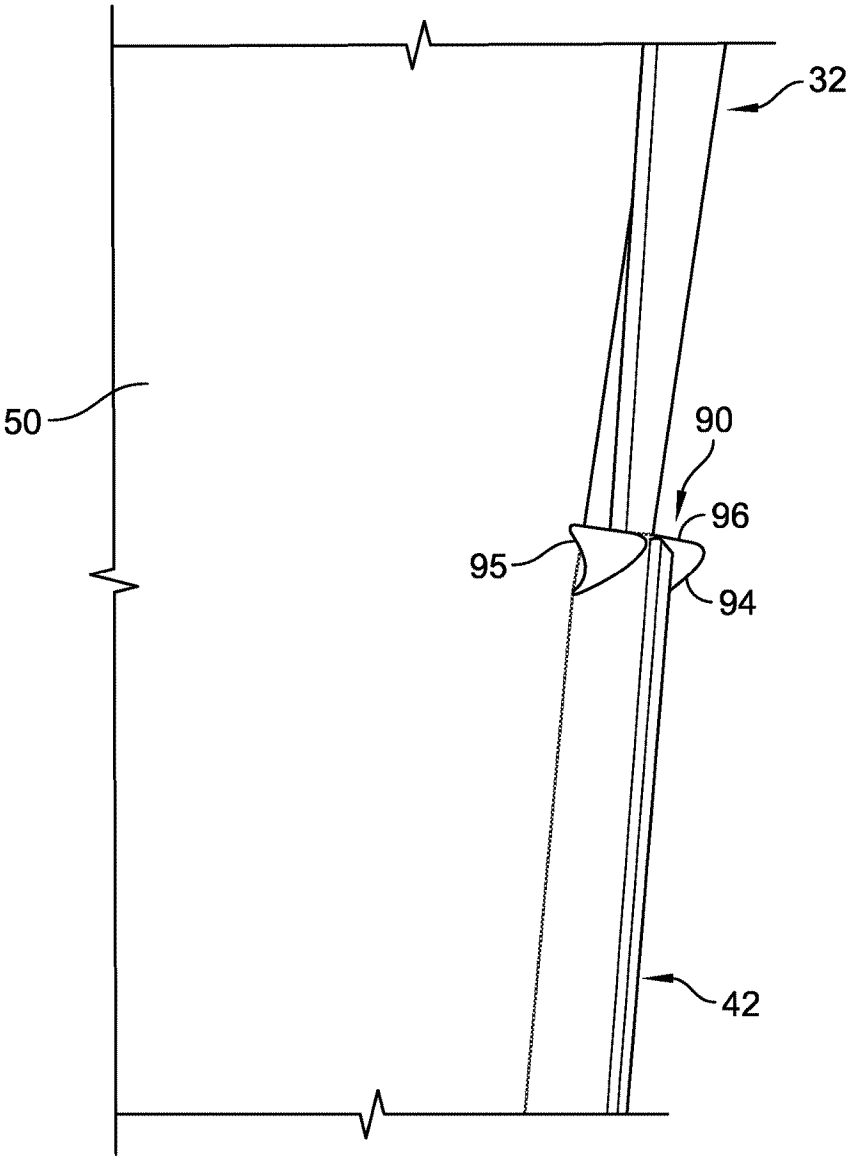
FIG. 12 is a perspective view of the outlet guide vane of FIG. 9, showing the first air manipulating member configured as a winglet.

As shown in FIGS. 10-12, the air manipulating member 90 may be configured as a winglet 90 that reduce radial flows across the tip and hub segments 32, 42. This is particularly helpful when the tip and hub segments 32, 42 are set to non-neutral, opposing pitch angles. As shown in FIG. 10, the winglet 90 may be generally planar and include a radially outer winglet surface 91 and a radially inner winglet surface 92, each surface generally facing radially. The winglet 90 further includes an axially aft end 93, a suction side edge 94, and a pressure side edge 95. The suction and pressure side edges 94, 95 may be curved similarly to the curvature of the airfoil shape of the vane 30.

The winglet 90 further includes a forward edge 96 that is curved. In some embodiments, the forward edge 96 is curved to match the rotational path, or path of movement, of the leading edge 33, 43 of the tip and hub segments 32, 42. In particular, the forward edge 96 may include a radius of curvature 97 that matches the rotational path of the tip and hub segments 32, 42, as shown in FIG. 10. In some embodiments, a width 90W of the winglet 90 is equal to or greater than a width 30W of the first tip segment 32 and the first hub segment 42 along an entire axial extent of the first tip segment 32 and the first hub segment 42. In some embodiments, the width of the winglet 90 at the axially aft end 93 is less than a length of the forward edge 96. In some embodiments, the winglet 90 has a radial height that allows for the seal to barely contact or nearly contact the sides 36, 45 of the tip and hub segments 32, 42 so as to prevent flow from entering this gap.

FIG. 11 and FIG. 12 show a side and front perspective view, respectively, of the winglet 90. In the example shown in FIG. 9, the tip segment 32 is moved to a first pitch angle, which is to the left of a neutral zero angle position when viewing FIG. 10 and FIG. 11. As can be seen, the forward edge 96 is long enough such that the pressure side edge 95 is located beyond the position of the tip segment 32 in the circumferential direction. In some embodiments, the forward edge 96 is formed to be long enough such that both the suction and pressure side edges 94, 95 are located outside of the potential range of pitch angle positions of the tip and hub segments 32, 42. This ensures that radial flows across the tip and hub segments 32, 42 will continue to be better matched at all pitch angle positions of the tip and hub segments 32, 42.

Figure 13:
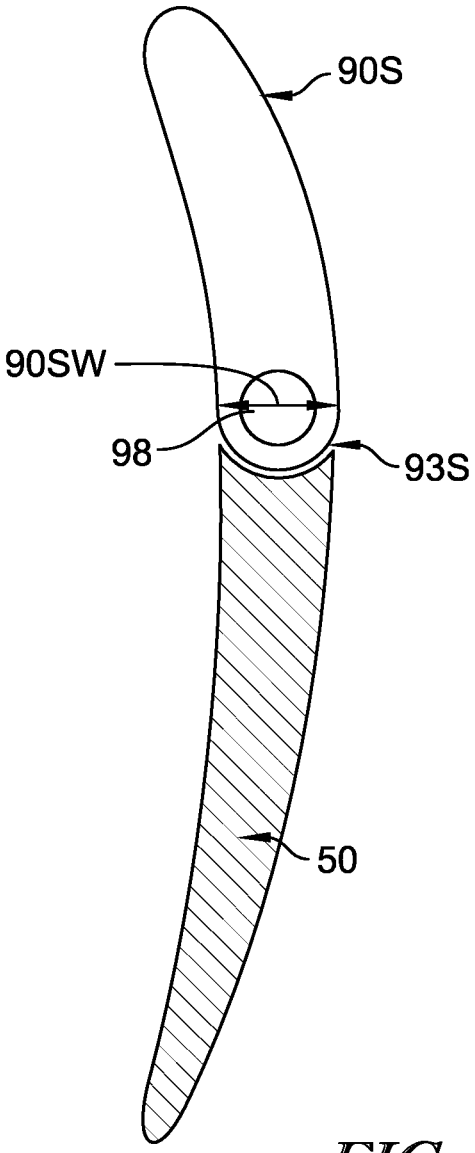
FIG. 13 is a top cross-sectional view of the outlet guide vane of FIG. 9, showing a top view of the first air manipulating member configured as a seal.

As can be seen in FIG. 13, the air manipulating member 90 may be configured as a seal 90S which is coupled to the axially forward side 53 of the fixed aft portion 50 at an axially aft end 93S of the seal 90S. The seal 90S may be generally planar. In some embodiments, the seal 90S has a radial height that allows for the seal to barely contact or nearly contact the sides 36, 45 of the tip and hub segments 32, 42 so as to seal the radial gap between the segments 32, 42 and prevent flow from entering this gap. In some embodiments, the seal 90S may be directly coupled to the radially inner side 36 of the tip segment 32. In some embodiments, the seal 90S may be directly coupled to the radially outer side 45 of the hub segment 42. In some embodiments, a width 90SW of the seal 90S is equal to or greater than a width 30W of the first tip segment 32 and the first hub segment 42 along an entire axial extent of the first tip segment 32 and the first hub segment 42. In some embodiments, the seal 90S may include a cutout 98 so as to allow a hinge rod 37 to pass therethrough. The winglet 90 may include a similar cutout 98. In other embodiments in which the segments 32, 42 do not include a hinge rod, the cutout 98 would not be necessary. In some embodiments, an outer perimeter of the seal 90S generally corresponds to an outer perimeter of each of the first tip segment 32 and the first hub segment 42, as shown in FIG. 13.

A person skilled in the art will understand that all features and components of all embodiments described herein, including the guide vane assembly 28 described above and the outlet guide vane assemblies described below can be interchanged and modified to include some elements of some embodiments and other elements of other embodiments. For example, even though some embodiments are shown without a static central segment, these embodiments may include such a central segment, as described herein. Similarly, although some embodiments described two tip segments and two hub segments, some embodiments can include one tip and two hub segments, two tip and one hub segments, each with or without a static central hub section, or other combinations thereof. Similarly, the actuation assemblies can be interchanged, with some embodiments and configurations including pass-through actuation assemblies, two assemblies arranged at the tip and hub, different configurations of segmented and full annular rings, and the like.

Figure 14:
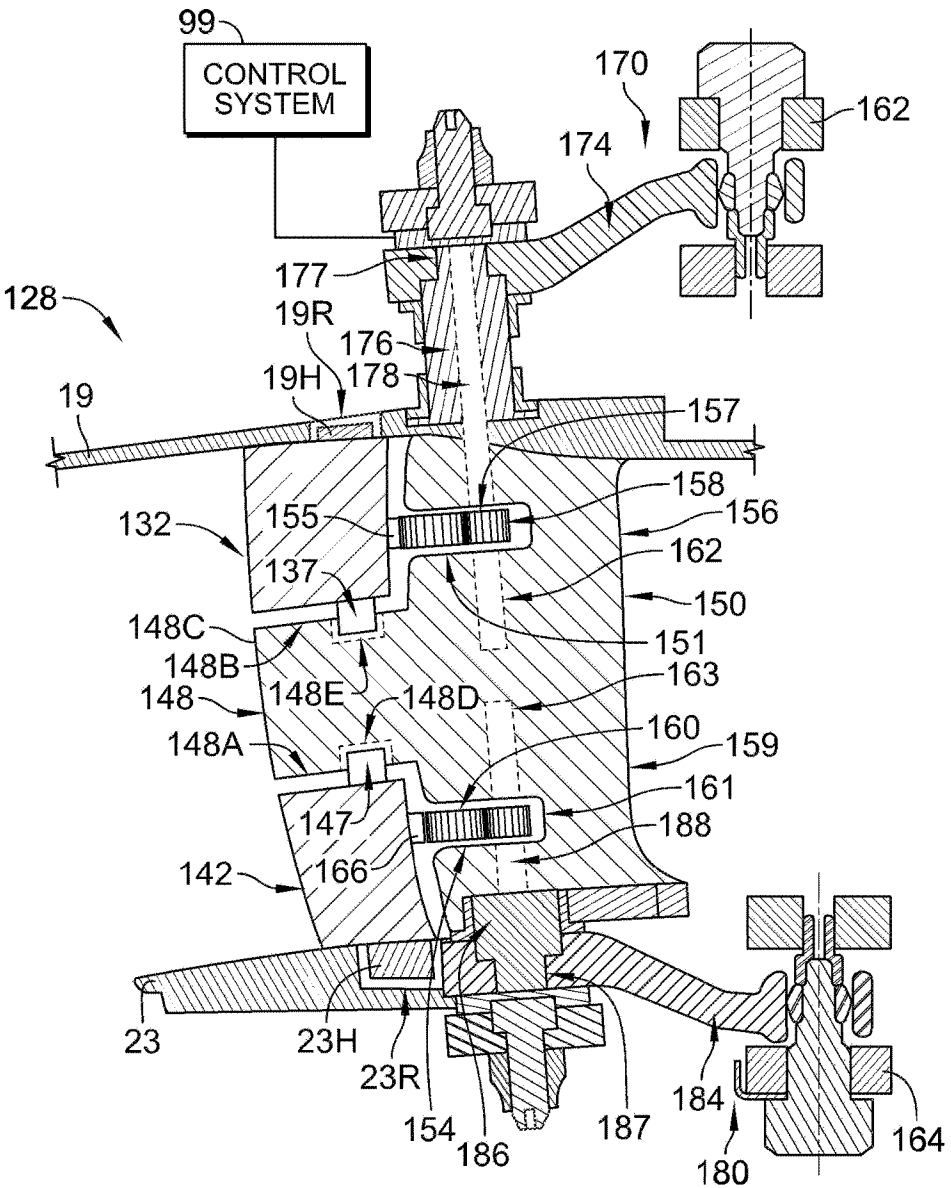
FIG. 14 is a side cross-sectional view of a first variable leading edge outlet guide vane according to a further aspect of the present disclosure, showing that the first variable leading edge outlet guide vane includes a first tip segment and a first hub segment, showing that the outlet guide vane assembly includes a first actuation assembly arranged radially outward of the fixed aft portion and including a first actuation rod with a first gear assembly attached thereto that rotates the first tip segment, showing that the outlet guide vane assembly includes a second actuation assembly arranged radially inward of the fixed aft portion and including a second actuation rod with a second gear assembly attached thereto that rotates the first hub segment, and showing that the guide vane further includes a static central portion arranged radially between the first tip segment and the first hub segment.
Figure 15:
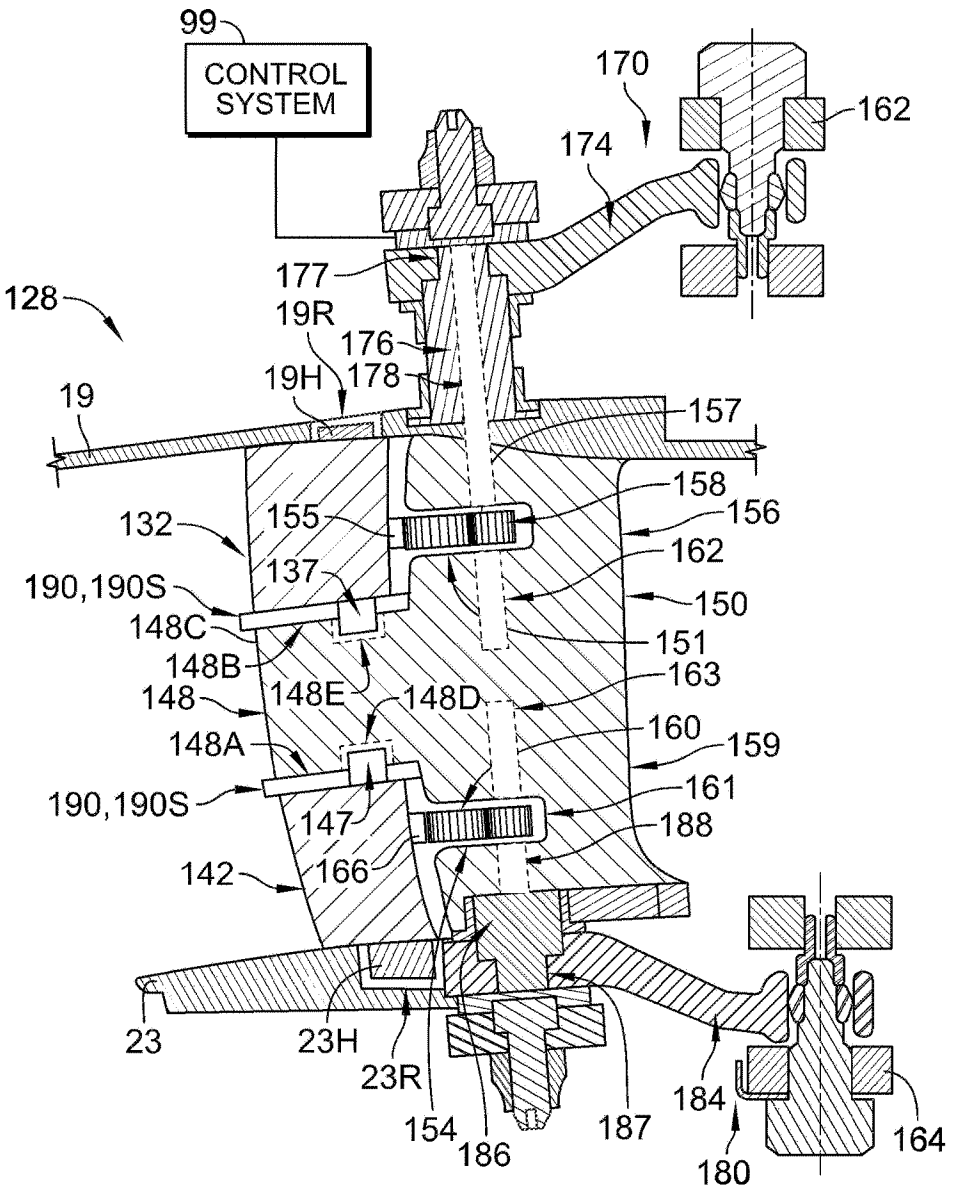
FIG. 15 is a side cross-sectional view of the outlet guide vane of FIG. 14, showing that air manipulating members configured as a winglets or seals can be arranged between the first tip and hub segments and the static central portion.
Figure 16:
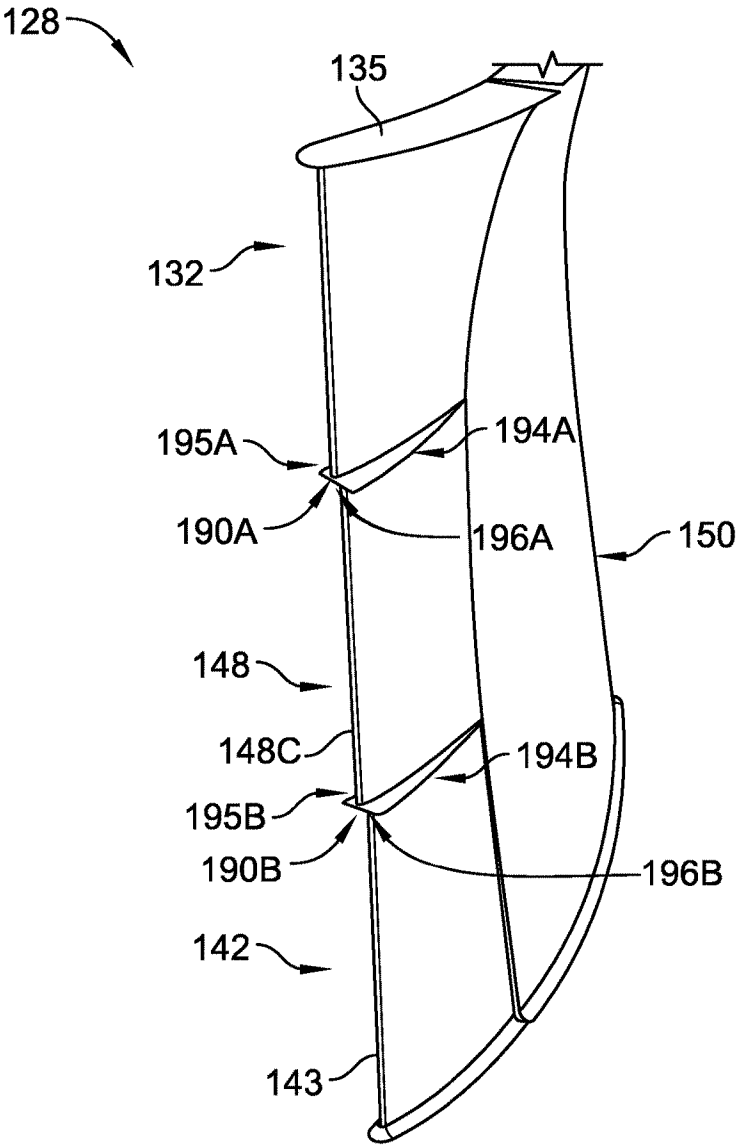
FIG. 16 is a perspective view of the outlet guide vane of FIG. 14, showing that air manipulating members configured as a winglets can be arranged between the first tip and hub segments and the static central portion.

Another embodiment of an outlet guide vane assembly 128 is shown in FIGS. 14-16. The outlet guide vane assembly 128 is similar to the outlet guide vane assembly 28 shown in FIGS. 1-13 and described herein. Accordingly, similar reference numbers in the 100 series indicate features that are common between the outlet guide vane assembly 128 and the outlet guide vane assembly 28. The description of the outlet guide vane assembly 28 is incorporated by reference to apply to the outlet guide vane assembly 128, except in instances when they conflict with the specific description and the drawings of the outlet guide vane assembly 128.

Similar to the outlet guide vane assembly 28 described above, the outlet guide vane assembly 128 includes first tip and hub segments 132, 142. In this embodiment, the first variable leading edge outlet guide vane 130 further includes a central segment 148 arranged between the first tip segment 132 and the first hub segment 142 such that the first tip segment 132 and the first hub segment 142 are radially spaced apart. In some embodiments, the central segment may be coupled to and extend axially away from the axially forward side 153 of the fixed aft portion 150. The central segment 148 is static and does not rotate.

As can be seen in FIG. 14, the central segment 148 includes a radially outer side 148A, a radially inner side 148B, and an axially forward end 148C extending between the radially outer and inner sides 148A, 148B and partially defining the leading edge of the vane 130 along with the tip and hub segments 132, 142. The central segment 148 may further include a radially outer hinge rod receiving cavity 148D configured to receive a hinge rod 137A of the tip segment 132, and a radially inner hinge rod receiving cavity 148E configured to receive a hinge rod 147A of hub segment 142. The central segment 148 may provide stability to the tip and hub segments 132, 142, as well as allow for uninterrupted flow over the central portion of the vane 130. The first tip and hub segments 132, 142 further include actuation rod receiving recesses 137B, 147B formed therein in that receive the actuation rods 155, 158, similar to the actuation rods 55, 58 described above.

Unlike the outlet guide vane assembly 28, the assembly 128 does not include a single actuation rod, but instead includes two actuation assemblies 170, 180 each having its own unique actuation rod 178, 188. The first actuation assembly 170 is configured to rotate the first tip segment 132, and the second actuation assembly 180 is configured to rotate the first hub segment 142. Although two actuation assemblies 170, 180 are shown in FIGS. 14 and 15, one of ordinary skill in the art will understand that a single actuation assembly 170, such as the actuation assembly 70 described above, can be utilized to rotate both gear assemblies 156, 159 and thus both of the tip and hub segments 132, 142.

As can be seen in FIG. 14, the first actuation assembly 170 includes a first actuation arm 174, a first actuation head 176 coupled to the first actuation arm 174, the first actuation rod 178, and the first gear assembly 156. Similar to the first actuation arm 74, first actuation head 76, first actuation rod 78, and first gear assembly 56 described above, the first actuation rod 178 is configured to be selectively rotated by pivoting movement of the actuation arm 174, and thus rotation of the actuation head 176, about the central axis of the actuation rod 178 so as to selectively rotate the gears 157, 158.

Rotation of the gears 157, 158 causes rotation of the first tip segment 132 about the leading edge pitch axis 139 to a first pitch angle relative to the incoming fan exit air 15.

The components of the first actuation assembly 170, including the first actuation arm 174, the first actuation head 176, the first actuation rod 178, and the gears 157, 158, may be arranged similarly to the first actuation arm 74, first actuation head 76, first actuation rod 78, and gears 57, 58 described above. In particular, the first actuation assembly 170 is arranged radially outward of the fixed aft portion 150 such that the first actuation head 176 is arranged at least partially within the fan duct outer casing 19.

As can be seen in FIG. 14, the second actuation assembly 180 is formed similarly to the first actuation assembly 170. In particular the second actuation assembly 180 includes a second actuation arm 184, a second actuation head 186 coupled to the second actuation arm 184, the second actuation rod 188, and a second gear assembly 159 fixedly coupled to the second actuation rod 188. The second actuation rod 188 can be radially spaced apart from the first actuation rod 178 by a distance, such as the distance shown in FIG. 14, or can be located proximate to the first actuation rod 178, nearly touching the actuation rod 178.

Similar to the first actuation rod 178, the second actuation rod 188 is configured to be selectively rotated by pivoting movement of the actuation arm 184, and thus rotation of the actuation head 186, about the central axis of the actuation rod 188 so as to selectively rotate the gears 160, 161. Rotation of the gears 160, 161 causes rotation of the first hub segment 142 about the leading edge pitch axis 139 to a second pitch angle relative to the incoming fan exit air 15. The second pitch angle can be the same or different than the first pitch angle.

The second actuation assembly 180 is arranged radially inward of the fixed aft portion 150 such that the second actuation head 186 is arranged at least partially within the inner wall 23.

Similar to the first actuation assembly 170, the second actuation assembly 180 can include a second annular ring 164, or annular ring segments or individually actuators arranged radially inward of the fan duct 24, as shown in FIG. 14. Circumferential movement of the second annular ring 164 moves the actuation arm 184, or actuation arms 184 when there are a plurality of outlet guide vanes 130, thus rotating the first hub segment 142. In some embodiments, actuation rod receiving cavities 162, 163 may be formed in the fixed aft portion 150 though which the actuation rods 178, 188 may extend. The second annular ring 164 may be formed and function similarly as to the first annular ring 62 described above, differing in that it is arranged radially inward of the vane 130.

In some embodiments, the outlet guide vane assembly 128 may include a single or multiple air manipulating members 190, 190S arranged in the small radial gaps between the tip segment 132 and central segment 148 and between the hub segment 142 and central segment 148, as shown in FIG. 15. The air manipulating members 190, 190S may be formed similarly to the air manipulating member 90 described above, in particular formed as seals 190S or winglets 190.

In some embodiments, one of the air manipulating members 190, 190S may be formed as a winglet while the other is formed as a seal. In some embodiments, both of the air manipulating members 190, 190S are formed as a seal. In some embodiments, both of the air manipulating members 190, 190S are formed as a winglet. In embodiments in which the tip and hub segments 132, 142 are rotationally attached to the central segment 148 via hinge rods similar to those described above, the air manipulating members 190, 190S can include a cutout (not shown but similar to the cutout 98) to allow the hinge rods to pass therethrough. In other arrangements in which the tip and hub segments 132, 142 are entirely spaced apart from the central segment 148, the cutout would not be necessary.

As can be seen in FIG. 16, the forward edge 196A of the winglet 190A is long enough such that the pressure side edge 195A is located beyond the position of the tip segment 132 in the circumferential direction. Similarly, the forward edge 196B of the winglet 190B is long enough such that the suction side edge 194B is located beyond the position of the hub segment 142 in the circumferential direction. In some embodiments, the forward edges 196A, 196B are formed to be long enough such that both the suction and pressure side edges 194A, 194B, 195A, 195B are located outside of the potential range of pitch angle positions of the tip and hub segments 132, 142. This ensures that radial flows across the tip and hub segments 132, 142 will continue to be better matched at all pitch angle positions of the tip and hub segments 132, 142.

Figure 17:
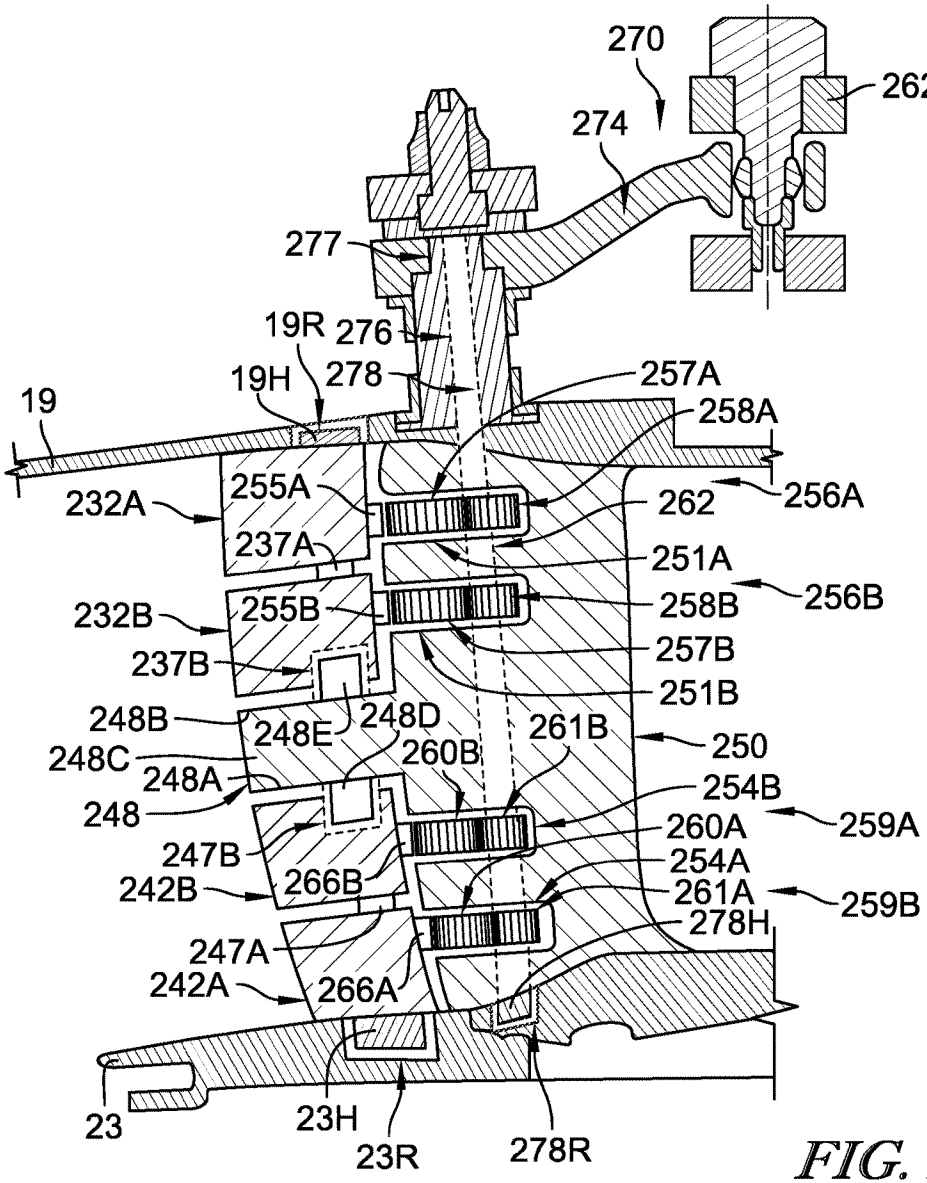
FIG. 17 is a side cross-sectional view of a first variable leading edge outlet guide vane according to a further aspect of the present disclosure, showing that the first variable leading edge outlet guide vane includes two tip segments and two hub segments, showing that the outlet guide vane assembly includes a first actuation assembly arranged radially outward of the fixed aft portion and including a first actuation rod with a gear assemblies attached thereto that are each associated with a respective tip or hub segment and that each rotate the respective segment, and showing that the guide vane further includes a static central portion arranged radially between the first tip segment and the first hub segment.
Figure 18:
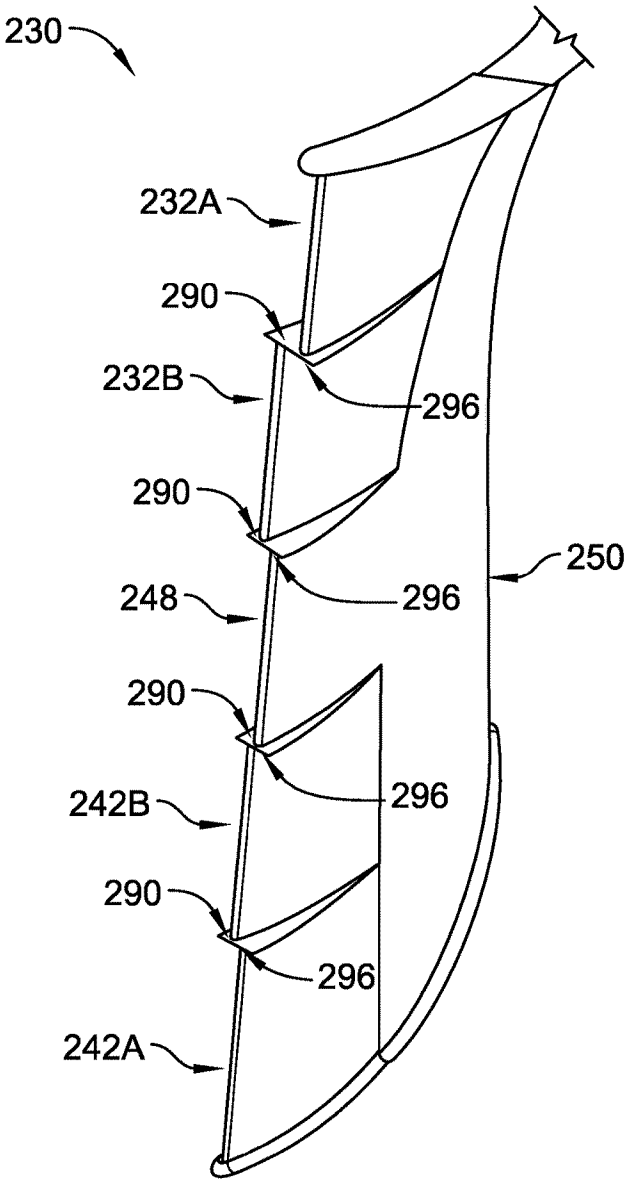
FIG. 18 is a perspective view of the outlet guide vane of FIG. 17, showing that air manipulating members configured as a winglets can be arranged between the first and second tip and hub segments and the static central portion.

Another embodiment of an outlet guide vane assembly 228 is shown in FIG. 17 and FIG. 18. The outlet guide vane assembly 228 is similar to the outlet guide vane assemblies 28, 128 shown in FIGS. 1-16 and described herein. Accordingly, similar reference numbers in the 200 series indicate features that are common between the outlet guide vane assembly 228 and the outlet guide vane assemblies 28, 128. The descriptions of the outlet guide vane assemblies 28, 128 are incorporated by reference to apply to the outlet guide vane assembly 228, except in instances when they conflict with the specific description and the drawings of the outlet guide vane assembly 228.

Similar to the outlet guide vane assemblies 28, 128 described above, the outlet guide vane assembly 228 includes first tip and hub segments 232A, 242A and a central segment 248. Unlike the assemblies described above, the outlet guide vane assembly 228 further includes a second tip segment 232B and a second hub segment 242B arranged radially between the first tip segment 232A and the central segment 248 and between the first hub segment 242A and the central segment 248, respectively. The additional second tip segment 232B and second hub segment 242B allow for additional variations of the fan exit air 15 flowing over the vane 230.

In order to move all four segments 232A, 232B, 242A, 242B, the assembly 228 includes a first actuation assembly 270 configured substantially similarly to the actuation assemblies 70, 170. Specifically, instead of two gear assemblies arranged on a single actuation rod 278, such as the gear assemblies 56, 59 described above, the first actuation assembly 270 includes four gear assemblies 256A, 256B, 259A, 259B each associated with a respective segment 232A, 232B, 242A, 242B, as shown in FIG. 16. Each gear assembly 256A, 256B, 259A, 259B is arranged in a respective cavity 251A, 251B, 254A, 254B formed in the fixed aft portion 250. Similar to the actuation assemblies 70, 170, the gear assemblies 256A, 256B, 259A, 259B can be selectively configured (i.e. types, sizes, and tooth configurations of gears can be selected and included in the assembly) such that rotation of the actuation rod 278 can cause the segments 232A, 232B, 242A, 242B to move to the same or differing pitch angles. In some embodiments, the segments 232A, 232B, 242A, 242B are rotatably hinged to each other via the same hinge and hinge receiving cavity arrangements as those described above with regard to the outlet guide vane assemblies 28, 128.

Similar to the outlet guide vane assembly 128, in some embodiments, the outlet guide vane assembly 228 may include a central segment 248 that is static and formed similarly to the central segment 148 described above. Moreover, in some embodiments, the outlet guide vane assembly 228 may include a single or multiple air manipulating members 290 arranged in the small radial gaps between the segment 232A, 232B, 242A, 242B and central segment 248, as shown in FIG. 18. The air manipulating members 290 may be formed similarly to the air manipulating member 90, 90S, 190, 190S described above, in particular formed as seals or winglets.

In some embodiments, one of the air manipulating members 290 may be formed as a winglet while the others are formed as seals. In some embodiments, one of the air manipulating members 290 may be formed as a seal while the others are formed as winglets. In some embodiments, two of the air manipulating members 290 may be formed as winglets while the others are formed as seals. In some embodiments, all of the air manipulating members 290 are formed as seals. In some embodiments, all of the air manipulating members 290 are formed as winglets.

As can be seen in FIG. 18, the forward edges 296 of the winglets 290 are long enough such that both the suction and pressure side edges are located outside of the potential range of pitch angle positions of the segments 232A, 232B, 242A, 242B. This ensures that radial flows across the segments 232A, 232B, 242A, 242B will continue to be better matched at all pitch angle positions of the segments 232A, 232B, 242A, 242B.

Figure 19:
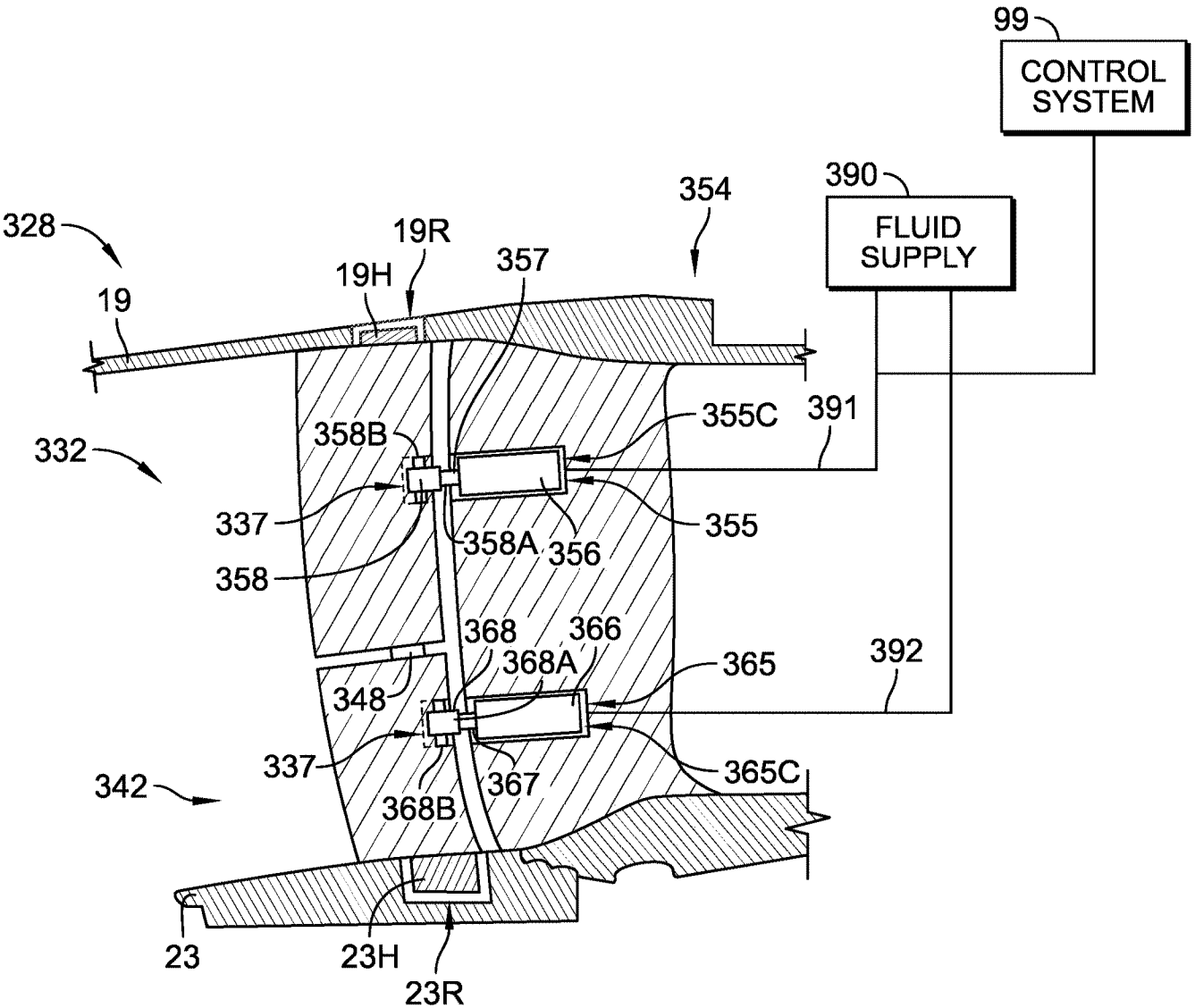
FIG. 19 is a side cross-sectional view of a first variable leading edge outlet guide vane according to a further aspect of the present disclosure, showing that the first variable leading edge outlet guide vane includes a first tip segment and a first hub segment, showing that the outlet guide vane assembly includes a first actuation assembly includes two hydraulic actuators configured to rotate the tip and hub segments.
Figure 20:
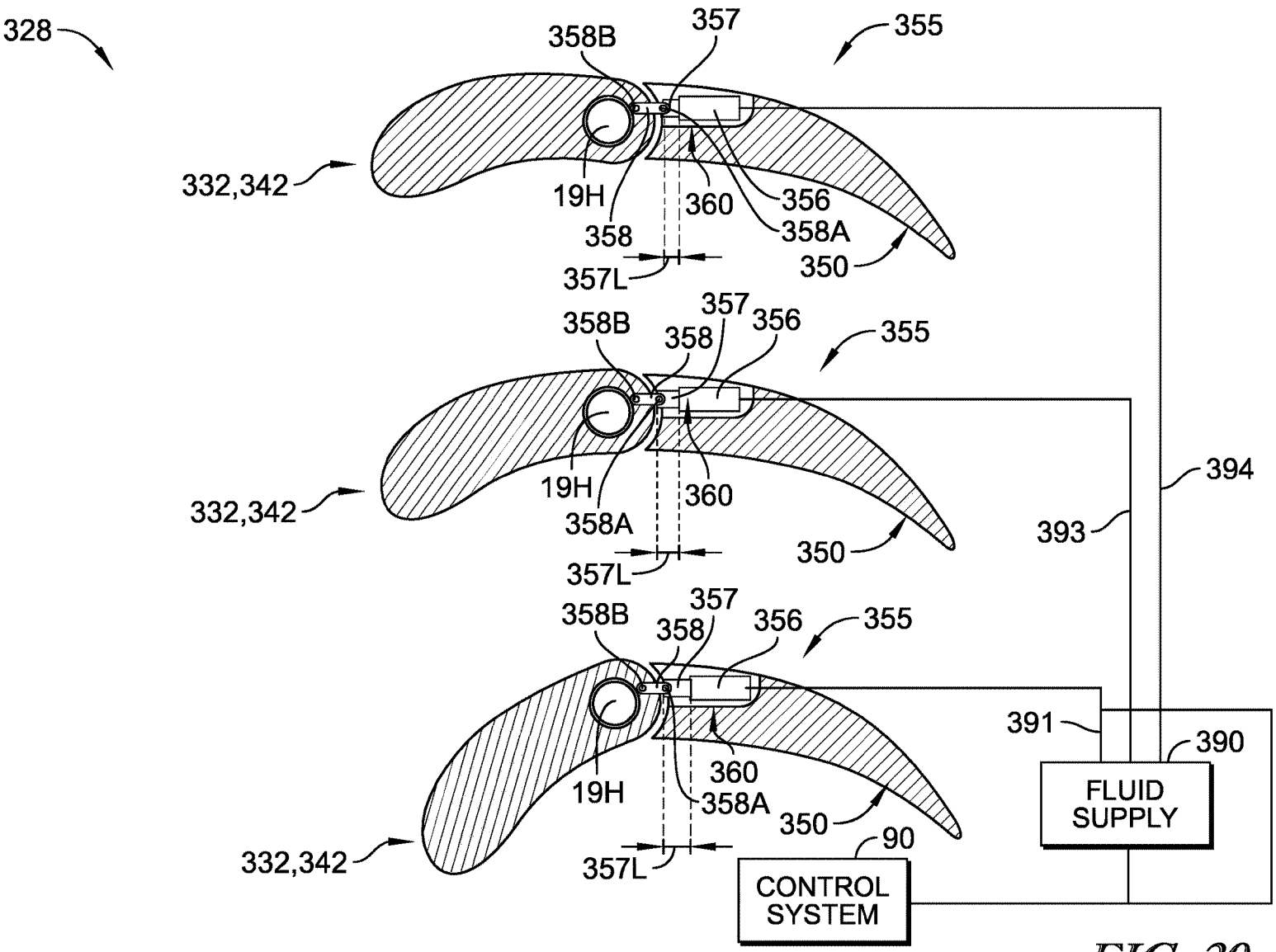
FIG. 20 is a top cross-sectional view of the first tip and/or hub segments of the outlet guide vane of FIG. 17, showing the hydraulic assemblies and different rotational positions of the first tip and/or hub segment based on the position of the respective hydraulic assembly.

Another embodiment of an outlet guide vane assembly 328 is shown in FIG. 19 and FIG. 20. The outlet guide vane assembly 328 is similar to the outlet guide vane assemblies 28, 128, 228 shown in FIGS. 1-18 and described herein. Accordingly, similar reference numbers in the 300 series indicate features that are common between the outlet guide vane assembly 328 and the outlet guide vane assemblies 28, 128, 128, 228. The descriptions of the outlet guide vane assemblies 28, 128, 228 are incorporated by reference to apply to the outlet guide vane assembly 328, except in instances when they conflict with the specific description and the drawings of the outlet guide vane assembly 328.

The outlet guide vane assembly 328 is similar to the outlet guide vane assemblies 28, 128 described above, in particular including first tip and hub segments 332, 342 that are rotated via actuation mechanisms. Unlike the outlet guide vane assemblies 28, 128, 228, the assembly 328 does not include gears or the actuation assemblies described above, but instead includes a hydraulic actuation assembly 354, as shown in FIG. 19 and FIG. 20. In some embodiments, the actuation assemblies may include pneumatic or electric actuators, or combinations of hydraulic, pneumatic, and electric. Any other actuator known to a person skilled in the art could be utilized as well.

The hydraulic actuation assembly 354 can include a first hydraulic actuator 355 and a second hydraulic actuator 365. The two actuators 355, 365 can be formed substantially similarly and used interchangeably for the first tip and hub segments 332, 342. As such, although only the first hydraulic actuator 355 is shown in FIG. 20, the same configurations and structural features apply to the second hydraulic actuator 365.

As can be seen in FIG. 19 and FIG. 20, the hydraulic actuator 355, 365 includes an actuation cylinder 356, 366 and an actuation piston 357, 367 configured to move outwardly and inwardly relative to the cylinder 356, 366. The actuators 355, 365 are arranged entirely within cavities 355C, 365C formed in the fixed aft portion 350 such that they are entirely surrounded by the walls of the vane 330 and do not protrude therebeyond.

The hydraulic actuator 355, 365 may be fluidically coupled to a hydraulic fluid supply 390, which is controlled by the control system 99 to supply a fluid to the cylinder 356, 366 so as to control movement of the piston 357, 367. The first hydraulic actuator 355 can be fluidically connected to the hydraulic fluid supply 390 via a first fluid line 391, and the second hydraulic actuator 365 can be coupled to the hydraulic fluid supply 390 via a first fluid line 392.

The actuation piston 357, 367 can be directly coupled to the first tip or hub segment 332, 342, or an actuation rod 358, 368 can extend between an end of the piston 357, 367 and the first tip or hub segment 332, 342, as shown in FIG. 19 and FIG. 20. In particular, the actuation rod 358, 368 can include a first end 358A, 368A coupled to the piston 357, 367 and a second opposing end 358B, 368B rotatably coupled to the first tip or hub segment 332, 342. The actuation rod 358, 368 is rotatably coupled to the first tip or hub segment 332, 342 at a point offset from the leading edge pitch axis 339 in the circumferential direction such that axially forward movement of the actuation rod 358, 368 rotates the first tip or hub segment 332, 342 in the first rotational direction (downward direction when viewing FIG. 20). As can be seen in FIG. 20, the greater the distance 357L that the piston 357, 367 extends from the cylinder 356, 366, the greater the segment 332, 342 will rotate.

In operation, the hydraulic actuators 355, 365 are actuated via control by the control system 99 or other known means by controlling a fluid flow to the actuators 355, 365 via the hydraulic fluid supply 390 and the fluid lines 391, 392. In this way, the first tip segment 332 can be selectively rotated about the leading edge pitch axis 339 to a first pitch angle relative to the incoming fan exit air 15. Similarly, the first hub segment 342 can be selectively rotated about the leading edge pitch axis 39 to a second pitch angle or the same first pitch angle relative to the incoming fan exit air 15. As shown in FIG. 20, in configurations with a plurality of vanes 330, the assembly 354 can include multiple fluid lines 393, 394 extending to additional hydraulic actuators 355 (and, although not shown, additional fluid lines extending to additional hydraulic actuators 365) so as to control individual segments 332, 342 of individual vanes 330, groups of vanes 330, or every vane 330 around the circumference of engine.

Figure 21:
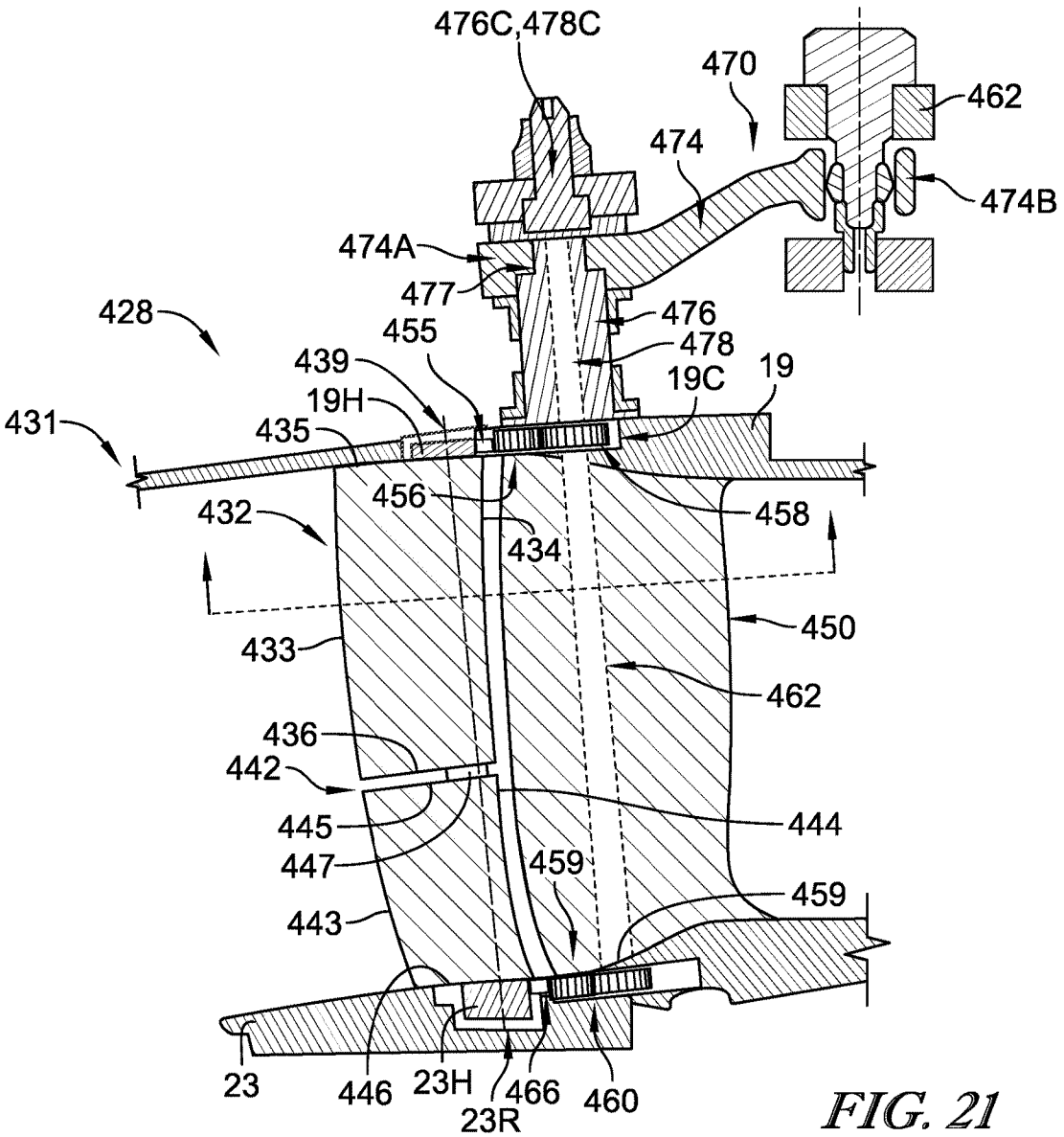
FIG. 21 is a side cross-sectional view of a first variable leading edge outlet guide vane according to a further aspect of the present disclosure, showing that the engine further includes an outer casing and an inner wall that define a fan duct passage through which the fan exit air flows, showing that the first variable leading edge outlet guide vane includes a first tip segment and a first hub segment, and showing that the outlet guide vane assembly includes a first actuation assembly including two gear assemblies, one gear assembly being arranged within the outer casing and configured to rotate the first tip segment and the other gear assembly being arranged within the inner wall and configured to rotate the first hub segment.

Another embodiment of an outlet guide vane assembly 428 is shown in FIG. 21. The outlet guide vane assembly 428 is similar to the outlet guide vane assemblies 28, 128, 228, 328 shown in FIGS. 1-20 and described herein. Accordingly, similar reference numbers in the 400 series indicate features that are common between the outlet guide vane assembly 428 and the outlet guide vane assemblies 28, 128, 228, 328. The descriptions of the outlet guide vane assemblies 28, 128, 228, 328 are incorporated by reference to apply to the outlet guide vane assembly 428, except in instances when they conflict with the specific description and the drawings of the outlet guide vane assembly 428.

Similar to the outlet guide vane assembly 28 described above, the outlet guide vane assembly 428 includes first tip and hub segments 432, 442 as well as first and second gear assemblies 456, 459. In this embodiment, the first tip and hub segments 432, 442 include first and second gears 455, 466 fixedly coupled to the radially outer and radially inner hub members 19H, 23H of the tip and hub members 432, 442, and arranged within the radially outer and radially inner hub receiving recesses 19R, 23R, as shown in FIG. 21. The first and second gears 455, 466 are arranged entirely within the recesses 19R, 23R so as to not interference with the air flow over the vane 430.

The first and second gears 455, 466 are configured to engage with the teeth of the gears of the gear assemblies 456, 459 in order to rotate the first tip and hub segments 432, 442. Similar to the gear assemblies 55, 59 described above, the gear assemblies 456, 459 each include two gears 457, 458, 460, 461. However, in such embodiments as that shown in FIG. 21, the two gears 457, 458 are arranged entirely within the outer fan duct casing 19 and interact with the first gear 455, and the two gears 460, 461 are arranged entirely within the inner wall 23 and interact with the second gear 466. In some embodiments, only a single gear or more than two gears may be used to interact with the respective first or second gear 455, 466.

The first actuation rod 478 is fixedly coupled to the axially aftmost gear (gears 458, 461 as shown in FIG. 21) and extends through the fixed aft portion 450 such that rotation of the rod 478 rotates the first tip and hub segments 432, 442. The number of gear teeth and size of the first and second gears 455, 466, as well as the number of gear teeth and size of the gears 457, 458, 460, 461, affects the range of pitch angles that the first tip and hub segments 432, 442 can be rotated to.

A method can include arranging a fan duct 20 circumferentially around a central axis 11, providing a fan 21 comprising a plurality of fan blades 22 that extend radially outward relative to the central axis 11 and that are adapted to rotate about the central axis 11 to force fan exit air 15 toward an aft end of the fan duct 20, and arranging an outlet guide vane assembly 28 in the fan duct 20 axially downstream of the fan 21 and configured to adjust a direction of incoming fan exit air 15 received from the plurality of fan blades 22 and reduce incidence between the outlet guide vane assembly 28 and the fan exit air 15, the outlet guide vane assembly 28 including a first variable leading edge guide vane 30 that extends radially relative to the central axis 11 and includes a leading edge portion 31 and a fixed aft portion 50, the leading edge portion 31 including a first tip segment 32 configured to rotate about a leading edge pitch axis 39 and a first hub segment 42 located radially inward of and separate from the first tip segment 32, the first hub segment 32 configured to independently rotate about the leading edge pitch axis 39 relative to the first tip segment 32, the first tip segment 32 including a first plurality of gear teeth 55 arranged thereon, the first hub segment 42 including a second plurality of gear teeth 66 arranged thereon.

The method can further include arranging a first actuation assembly 70 relative to the first variable leading edge guide vane 30, the first actuation assembly 70 including a first actuation rod 78, coupling a first gear assembly 56 to the first actuation rod 78, the first gear assembly 56 in engagement with the first plurality of gear teeth 55 arranged on the first tip segment 32, and selectively coupling a second gear assembly 59 to the first actuation rod 78 radially spaced apart from the first gear assembly 56, the second gear assembly 59 in engagement with the second plurality of gear teeth 66 arranged on the first hub segment 42. The first actuation rod 78 is configured to be selectively rotated so as to rotate the first and second gear assemblies 56, 59. Rotation of the first gear assembly 56 causes rotation of the first tip segment 32 about the leading edge pitch axis 39 to a first pitch angle relative to the incoming fan exit air 15, and rotation of the second gear assembly 59 causes rotation of the first hub segment 42 about the leading edge pitch axis 39 to a second pitch angle relative to the incoming fan exit air 15.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected. Moreover, each of the embodiments described herein, including the specific features and characteristics of each embodiment, may be combined with other embodiments as would be understood by one of ordinary skill in the art.

What is claimed is:

1. A fan assembly for a gas turbine engine the fan assembly comprising a fan duct arranged circumferentially around a central axis, a fan comprising a plurality of fan blades that extend radially outward relative to the central axis and that are adapted to rotate about the central axis to force fan exit air toward an aft end of the fan duct, and an outlet guide vane assembly located in the fan duct axially downstream of the fan and configured to adjust a direction of incoming fan exit air received from the plurality of fan blades and reduce incidence between the outlet guide vane assembly and the fan exit air, the outlet guide vane assembly including a first variable leading edge outlet guide vane that extends radially relative to the central axis and includes a leading edge portion and a fixed aft portion, the leading edge portion including a first tip segment configured to rotate about a leading edge pitch axis and a first hub segment located radially inward of and separate from the first tip segment, the first hub segment configured to independently rotate about the leading edge pitch axis relative to the first tip segment, the first tip segment including a first plurality of gear teeth arranged thereon, the first hub segment including a second plurality of gear teeth arranged thereon, and a first actuation assembly including a first actuation rod, a first gear assembly coupled to the first actuation rod and in engagement with the first plurality of gear teeth of the first tip segment, and a second gear assembly coupled to the first actuation rod and in engagement with the second plurality of gear teeth of the first hub segment, wherein the first actuation rod is configured to be selectively rotated so as to rotate the first and second gear assemblies, wherein rotation of the first gear assembly causes rotation of the first tip segment about the leading edge pitch axis to a first pitch angle relative to the incoming fan exit air, and wherein rotation of the second gear assembly causes rotation of the first hub segment about the leading edge pitch axis to a second pitch angle relative to the incoming fan exit air.

2. The fan assembly of claim 1, wherein the first actuation assembly is configured to rotate the first tip segment and the first hub segment to the first pitch angle and the second pitch angle which is different than the first pitch angle.

3. The fan assembly of claim 2, wherein the first gear assembly includes a first gear rotatably coupled to a first cavity formed in the fixed aft portion and in engagement with the first plurality of gear teeth of the first tip segment, wherein the first gear assembly further includes a second gear fixedly coupled to the first actuation rod and in engagement with the first gear, and wherein rotation of the second gear in a first rotational direction via the first actuation rod causes rotation of the first tip segment in the first rotational direction via engagement with the first gear.

4. The fan assembly of claim 3, wherein the second gear assembly is radially spaced apart from the first gear assembly and includes a third gear rotatably coupled to a second cavity formed in the fixed aft portion and in engagement with the second plurality of gear teeth of the first hub segment, wherein the second gear assembly further includes a fourth gear fixedly coupled to the first actuation rod and in engagement with the third gear, and wherein rotation of the fourth gear in the first rotational direction via the first actuation rod causes rotation of the first hub segment in the first rotational direction via engagement with the third gear.

5. The fan assembly of claim 4, wherein rotation of the second and fourth gears via the first actuation rod in a second rotational direction opposite the first rotational direction causes the first tip and hub segments to rotate in the second rotational direction.

6. The fan assembly of claim 5, wherein the second and fourth gears are smaller than and include fewer teeth than the first and third gears.

7. The fan assembly of claim 3, wherein the first actuation assembly is arranged radially generally outward of the fixed aft portion and includes a first actuation head, and wherein the first actuation rod is fixedly coupled to the first actuation head such that rotation of the first actuation head causes rotation of the first actuation rod.

8. The fan assembly of claim 7, wherein the first actuation assembly further includes a first actuation arm coupled to the first actuation head and extending generally axially aft therefrom, wherein pivoting of the first actuation arm about a rotation axis of the first actuation head causes rotation of the first actuation head which causes rotation of the first actuation rod.

9. The fan assembly of claim 8, wherein the fixed aft portion includes an actuation rod receiving cavity formed therethrough, and wherein the first actuation head is circumferentially aligned with the fixed aft portion such that the first actuation rod extends through the actuation rod receiving cavity.

10. The fan assembly of claim 8, wherein the first actuation head is circumferentially offset from the fixed aft portion such that the first actuation rod radially extends circumferentially adjacent to the fixed aft portion.

11. The fan assembly of claim 8, wherein the outlet guide vane assembly further includes a first annular ring extending circumferentially about the central axis, wherein an axially aft end of the first actuation arm is connected to the first annular ring, and wherein circumferential movement of the first annular ring causes movement of the first actuation arm generally circumferentially relative to the first actuation head which causes the first actuation arm to pivot about the rotation axis of the first actuation head which causes rotation of the first actuation head which causes rotation of the first actuation rod.

12. The fan assembly of claim 1, wherein the first variable leading edge outlet guide vane further includes a central segment arranged between the first tip segment and the first hub segment such that the first tip segment and the first hub segment are radially spaced apart.

13. The fan assembly of claim 12, wherein the central segment is coupled to and extends axially away from an axially forward side of the fixed aft portion.

14. A fan assembly for a gas turbine engine the fan assembly comprising a fan duct arranged circumferentially around a central axis, a fan adapted to rotate about the central axis to force fan exit air toward an aft end of the fan duct, and an outlet guide vane assembly located in the fan duct axially downstream of the fan and configured to adjust a direction of incoming fan exit air received from the plurality of fan blades and reduce incidence between the outlet guide vane assembly and the fan exit air, the outlet guide vane assembly including a first variable leading edge outlet guide vane including a leading edge portion and a fixed aft portion, the leading edge portion including a first tip segment configured to rotate about a leading edge pitch axis, the first tip segment including a first plurality of gear teeth arranged thereon, and a first actuation assembly including a first actuation rod and a first gear assembly coupled to the first actuation rod and in engagement with the first plurality of gear teeth of the first tip segment, wherein the first actuation rod is configured to be selectively rotated so as to rotate the first gear assembly, and wherein rotation of the first gear assembly causes rotation of the first tip segment about the leading edge pitch axis to a first pitch angle relative to the incoming fan exit air.

15. The fan assembly of claim 14, wherein the leading edge portion further includes a first hub segment located radially inward of and separate from the first tip segment, the first hub segment configured to independently rotate about the leading edge pitch axis relative to the first tip segment, and wherein the first hub segment includes a second plurality of gear teeth arranged thereon.

16. The fan assembly of claim 15, wherein the first actuation assembly further includes a second gear assembly coupled to the first actuation rod and in engagement with the second plurality of gear teeth of the first hub segment, wherein the selective rotation of the first actuation rod rotates the second gear assembly, and wherein rotation of the second gear assembly causes rotation of the first hub segment about the leading edge pitch axis to a second pitch angle relative to the incoming fan exit air.

17. The fan assembly of claim 16, wherein the first gear assembly includes a first gear rotatably coupled to a first cavity formed in the fixed aft portion and in engagement with the first plurality of gear teeth of the first tip segment, wherein the first gear assembly further includes a second gear fixedly coupled to the first actuation rod and in engagement with the first gear, and wherein rotation of the second gear in a first rotational direction via the first actuation rod causes rotation of the first tip segment in the first rotational direction via engagement with the first gear.

18. The fan assembly of claim 17, wherein the second gear assembly is radially spaced apart from the first gear assembly and includes a third gear rotatably coupled to a second cavity formed in the fixed aft portion and in engagement with the second plurality of gear teeth of the first hub segment, wherein the second gear assembly further includes a fourth gear fixedly coupled to the first actuation rod and in engagement with the third gear, and wherein rotation of the fourth gear in the first rotational direction via the first actuation rod causes rotation of the first hub segment in the first rotational direction via engagement with the third gear.

19. The fan assembly of claim 18, wherein rotation of the second and fourth gears via the first actuation rod in a second rotational direction opposite the first rotational direction causes the first tip and hub segments to rotate in the second rotational direction.

20. A method comprising arranging a fan duct circumferentially around a central axis, providing a fan comprising a plurality of fan blades that extend radially outward relative to the central axis and that are adapted to rotate about the central axis to force fan exit air toward an aft end of the fan duct, arranging an outlet guide vane assembly in the fan duct axially downstream of the fan and configured to adjust a direction of incoming fan exit air received from the plurality of fan blades and reduce incidence between the outlet guide vane assembly and the fan exit air, the outlet guide vane assembly including a first variable leading edge guide vane that extends radially relative to the central axis and includes a leading edge portion and a fixed aft portion, the leading edge portion including a first tip segment configured to rotate about a leading edge pitch axis and a first hub segment located radially inward of and separate from the first tip segment, the first hub segment configured to independently rotate about the leading edge pitch axis relative to the first tip segment, the first tip segment including a first plurality of gear teeth arranged thereon, the first hub segment including a second plurality of gear teeth arranged thereon, arranging a first actuation assembly relative to the first variable leading edge guide vane, the first actuation assembly including a first actuation rod, coupling a first gear assembly to the first actuation rod, the first gear assembly in engagement with the first plurality of gear teeth arranged on the first tip segment, and selectively coupling a second gear assembly to the first actuation rod radially spaced apart from the first gear assembly, the second gear assembly in engagement with the second plurality of gear teeth arranged on the first hub segment, wherein the first actuation rod is configured to be selectively rotated so as to rotate the first and second gear assemblies, wherein rotation of the first gear assembly causes rotation of the first tip segment about the leading edge pitch axis to a first pitch angle relative to the incoming fan exit air, and wherein rotation of the second gear assembly causes rotation of the first hub segment about the leading edge pitch axis to a second pitch angle relative to the incoming fan exit air.

* * * * *